US012628905B2

(12) United States Patent
Simone et al.

(10) Patent No.: US 12,628,905 B2
(45) Date of Patent: May 19, 2026

(54) ARTICLE OF FOOTWEAR HAVING A SOLE WITH HEEL SUPPORT AND FLUID CUSHIONING SYSTEM

(71) Applicant: Reebok International Limited, Altrincham (GB)

(72) Inventors: Dustin Simone, Westerly, RI (US); Abimelec Ramos, Lynn, MA (US); Kathleen Liu, Somerville, MA (US); John Greenhalgh, Foxboro, MA (US)

( * ) Notice: Subject to any disclaimer, the term of this patent is extended or adjusted under 35 U.S.C. 154(b) by 0 days.

(21) Appl. No.: 18/771,519

(22) Filed: Jul. 12, 2024

(65) Prior Publication Data

US 2026/0013595 A1 Jan. 15, 2026

(51) Int. Cl.
*A43B 13/18* (2006.01)
*A43B 13/20* (2006.01)

(52) U.S. Cl.
CPC ..... *A43B 13/186* (2013.01); *A43B 13/188* (2013.01); *A43B 13/206* (2013.01)

(58) Field of Classification Search
CPC ..... A43B 13/186; A43B 13/20; A43B 13/206; A43B 13/16; A43B 13/188; A43B 13/12
See application file for complete search history.

(56) References Cited

U.S. PATENT DOCUMENTS 6,354,020 B1 3/2002 Kimball et al.
6,453,577 B1 9/2002 Litchfield et al.
7,383,648 B1 6/2008 Litchfield et al.
9,955,750 B2 5/2018 Montross et al.
10,016,017 B2 7/2018 Christensen et al.
10,034,517 B2 7/2018 Christensen et al.
10,178,891 B2 1/2019 Christensen et al.
10,932,519 B2 3/2021 Bates et al.
11,246,375 B2 2/2022 Marvin et al.
11,272,755 B2 3/2022 Christensen et al.
11,291,270 B2 4/2022 Montross et al.
11,612,211 B2 3/2023 Christensen et al.
2009/0178299 A1* 7/2009 Lafortune ..... A43B 21/26 36/35 B
2010/0058617 A1* 3/2010 Hwang ..... A43B 9/00 36/43
2012/0117824 A1* 5/2012 Kim ..... A43B 13/182 36/105
2015/0040432 A1* 2/2015 Berend ..... A43B 13/20 36/102
2017/0265565 A1* 9/2017 Connell ..... A43B 13/206
(Continued)

*Primary Examiner* — Jameson D Collier
(74) *Attorney, Agent, or Firm* — Sterne, Kessler, Goldstein & Fox P.L.L.C.

(57) ABSTRACT

An article of footwear includes an upper and a sole coupled to the upper. The sole includes an outsole to engage the ground, a midsole disposed above the outsole to support a foot of a wearer, and a heel support member disposed between the midsole and the outsole in a heel region of the sole. The sole includes a plurality of heel air chambers bounded by the midsole and the heel support member in the heel region of the sole. The heel air chambers are fluidly connected by a heel channel. The sole includes a plurality of sole air chambers bounded by a bottom surface of the midsole and an upper surface of the outsole. The sole air chambers are arranged from the heel region of the sole to a forefoot region. The sole includes a plurality of channels fluidly connecting the plurality of sole air chambers.

20 Claims, 14 Drawing Sheets

(56) References Cited

U.S. PATENT DOCUMENTS

| | | | | |
|---|---|---|---|---|
| 2019/0231028 | A1* | 8/2019 | Eldem | A43B 5/06 |
| 2020/0205514 | A1* | 7/2020 | VanDomelen | A43B 13/188 |
| 2020/0288814 | A1* | 9/2020 | Chang | A43B 23/0265 |
| 2020/0305549 | A1* | 10/2020 | Bailly | A43B 13/125 |
| 2021/0145119 | A1* | 5/2021 | Campos, II | A43B 13/186 |
| 2021/0368921 | A1* | 12/2021 | Campos, II | A43B 13/18 |
| 2021/0368922 | A1* | 12/2021 | Ho | A43B 13/20 |
| 2022/0047040 | A1* | 2/2022 | Durflinger | A43B 13/185 |
| 2024/0130473 | A1* | 4/2024 | Campos, II | B29D 35/128 |
| 2025/0000207 | A1* | 1/2025 | Anceresi | A43B 13/20 |

* cited by examiner

ARTICLE OF FOOTWEAR HAVING A SOLE WITH HEEL SUPPORT AND FLUID CUSHIONING SYSTEM

BACKGROUND

Field of the Invention

The present disclosure relates to footwear, and more particularly relates to a sole and article of footwear having a heel support system and sole cushioning system for supporting a foot of a wearer.

Background Art

The human foot possesses natural cushioning and rebounding characteristics. However, the foot alone is incapable of effectively overcoming many of the forces encountered during every day activity, including athletic activity such as running, playing various sports, or working out. Unless an individual is wearing shoes which provide proper cushioning and support, the soreness and fatigue associated with every day activity is more acute, and its onset accelerated. The discomfort for the wearer that results may diminish the incentive for further activity.

Proper footwear should complement the natural functionality of the foot, in part, by incorporating a sole, which absorbs shocks. Therefore, a continuing need exists for innovations in providing cushioning to articles of footwear.

BRIEF SUMMARY

The present disclosure includes various embodiments of a sole for an article of footwear that provides a desired cushioning effect to a wearer's foot.

In accordance with one embodiment, an article of footwear includes an upper and a sole coupled to the upper. In some embodiments, the sole includes an outsole and a midsole. In some embodiments, the midsole includes a bottom surface facing an upper surface of the outsole. In some embodiments, the bottom surface of the midsole defines a plurality of bottom depressions indented into the first recessed surface. In some embodiments, the midsole includes an exterior side surface extending upward from the bottom surface. In some embodiments, the midsole includes a first recessed surface receding into the midsole away from the exterior side surface of the midsole and the bottom surface. In some embodiments, the first recessed surface defines a first midsole concavity indented into the first recessed surface. In some embodiments, the midsole includes a heel support member disposed between the first recessed surface of the midsole and the upper surface of the outsole. In some embodiments, the heel support member includes an upper surface defining a first member concavity indented into the heel support member. In some embodiments, the sole includes a first heel air chamber disposed between the midsole and the heel support member. In some embodiments, the first heel air chamber is bounded by the first midsole concavity and the first member concavity. In some embodiments, the sole includes a plurality of sole air chambers arranged from the heel region of the sole to a forefoot region of the sole. In some embodiments, each of the sole air chambers is bounded by a respective bottom depression of the midsole and the upper surface of the outsole.

In some embodiments, the midsole is formed of a foam-based material having a first durometer. In some embodiments, the heel support member is formed of a thermoplastic material having a second durometer that is greater than the first durometer.

In some embodiments, the midsole includes an upper surface located opposite to the bottom surface. In some embodiments, the upper surface of the midsole defines a plurality of upper depressions indented into the midsole. In some embodiments, the plurality of upper depressions are arranged from a heel region of the sole to a midfoot region of the sole.

In some embodiments, the article of footwear further includes a second heel air chamber disposed between the midsole and the heel support member. In some embodiments, the first heel air chamber is in fluid communication with the second air chamber.

In some embodiments, the midsole includes a second recessed surface receding into the midsole away from the exterior side surface and the bottom surface of the midsole. In some embodiments, the first recessed surface is disposed on a lateral section of the sole, and the second recessed surface is disposed on a medial section of the sole. In some embodiments, the heel support member is disposed between the second recessed surface of the midsole and the upper surface of the outsole.

In some embodiments, the second recessed surface of the midsole defines a second midsole concavity indented into the second recessed surface, and the upper surface of the heel support member defines a second member concavity indented into the heel support member. In some embodiments, the second heel air chamber is bounded by the second midsole concavity and the second member concavity.

In some embodiments, the first heel air chamber is in fluid communication with the second heel air chamber via a heel channel defined between the midsole and the heel support member.

The article of footwear further includes a third heel air chamber disposed between the midsole and the heel support member. In some embodiments, the third heel air chamber is in fluid communication with the first heel air chamber and the second heel air chamber via the heel channel.

In some embodiments, the midsole includes a back end surface disposed in the heel region of the sole, and the heel support member is engaged with the back end surface.

In some embodiments, the back end surface of the midsole defines a third midsole concavity and the upper surface of the heel support member defines a third member concavity. In some embodiments, the third heel air chamber is bounded by the third midsole concavity and the third member concavity.

In some embodiments, the first recessed surface of the midsole defines a second midsole concavity, and the upper surface of the heel support member defines a second member concavity. In some embodiments, the second heel air chamber is bounded by the second midsole concavity and the second member concavity.

In some embodiments, the first heel air chamber and the second heel air chamber are disposed on a lateral section of sole.

In some embodiments, the heel support member defines an opening extend through the upper surface and a bottoms surface of the heel support member. In some embodiments, the midsole includes a protrusion received in the opening of the heel support member.

In some embodiments, the plurality of sole air chambers are spaced apart evenly from the forefoot region of the sole to the heel region of the sole. In some embodiments, the article of footwear further comprises a plurality of sole channels bounded by the bottom surface of the midsole and the upper surface of the outsole and spaced apart evenly from the forefoot region of the sole to the heel region of the sole. In some embodiments, the plurality of sole channels fluidly connecting the plurality of sole air chambers.

In some embodiments, the plurality of sole air chambers include a set of sole air chambers that are each fluidly connected to four adjacent sole air chambers by four sole channels.

In accordance with one embodiment, a sole for an article of footwear includes an outsole, a midsole disposed above the outsole, a heel support member disposed between the midsole and the outsole in a heel region of the sole, a plurality of heel air chambers bounded by the midsole and the heel support member in the heel region of the sole. In some embodiments, the plurality of heel air chambers are fluidly connected by a heel channel. In some embodiments, the sole includes a plurality of sole air chambers bounded by a bottom surface of the midsole and an upper surface of the outsole. In some embodiments, the plurality of sole air chambers are arranged from the heel region of the sole to a forefoot region. In some embodiments, the sole includes a plurality of sole channels bounded by the bottom surface of the midsole and the upper surface of the outsole, in which the plurality of channels fluidly connect the plurality of sole air chambers. In some embodiments, the plurality of heel air chambers are fluidly isolated from the plurality of sole air chambers. In some embodiments, the midsole is formed of a first material having a first durometer, and the heel support member is formed of a second material having a second durometer that is greater than the first durometer.

In some embodiments, the bottom surface of the midsole defines a plurality of bottom depressions indented into the midsole and a plurality of grooves indented into the midsole. In some embodiments, each of the sole air chambers is bounded by a respective bottom depression of the midsole and the upper surface of the outsole. In some embodiments, each of the sole channels is bounded by a respective groove of the midsole and the upper surface of the outsole.

In some embodiments, the midsole defines a plurality of midsole concavities indented into the midsole and disposed in the heel region of the sole. In some embodiments, the heel support member includes an upper surface defining a plurality of member concavities indented into the heel support member. In some embodiments, the plurality of member concavities are aligned with the plurality of midsole concavities such that the plurality of heel air chambers are bounded by the plurality of midsole concavities and the plurality of member concavities.

In some embodiments, the midsole includes an upper surface located opposite to the bottom surface of the midsole, an exterior side surface extending in a vertical direction from the bottom surface to the upper surface, and a first recessed surface receding into the midsole away from the bottom surface of the midsole and the exterior side surface of the midsole disposed along the lateral side of the sole. In some embodiments, the first recessed surface includes a first midsole concavity indented into the first recessed surface and bounding at least one of the heel air chambers.

In some embodiments, the heel section of the midsole includes a second recessed surface receding into the midsole away from the bottom surface of the midsole and the exterior side surface of the midsole disposed along the medial side of the sole. In some embodiments, the second recessed surface includes a second midsole concavity indented into the second recessed surface and bounding at least one of the heel air chambers.

In some embodiments, the heel section of the midsole includes a third recessed surface receding into the midsole away from the bottom surface of the midsole and the exterior side surface of the midsole disposed along a back end of the sole. In some embodiments, the third recessed surface includes a third midsole concavity indented into the third recessed surface and bounding at least one of the heel air chambers.

In some embodiments, the first material of the midsole is a foam-based material, and the second material of the heel support is an injection-molded thermoplastic material.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
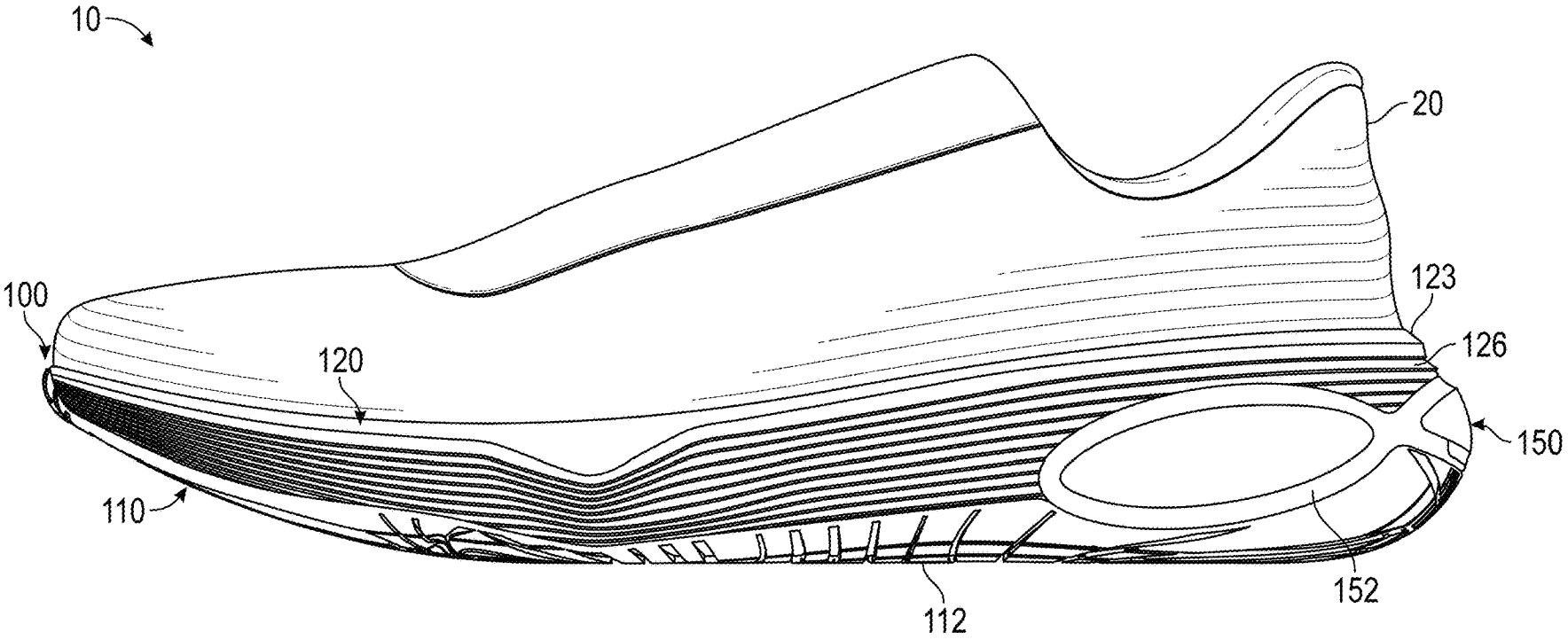
FIG. 1 shows a side view of an article of footwear.

The representative embodiments will now be described in detail with reference to the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting. Other suitable modifications and adaptations of the variety of conditions and parameters normally encountered in the field, and which would be apparent to those skilled in the art, are within the spirit and scope of the disclosure.

One attempt over the years to improve cushioning and resiliency of shoes, particularly athletic shoes, is incorporating a multi-chamber bladder in the shoe sole so that air is transferred between the heel and forefoot areas of a shoe during the wearer's gait motion. However, there are several difficulties associated with using a bladder filled with pressurized fluid within a shoe sole. Namely, it is difficult to maintain consistent air pressure within the chambers of the bladder due to leakage from usage, compromising a stable cushioning effect. Consequently, performance of shoe soles employed with pressurized bladders may benefit from improved consistency in air pressure and attendant cushioning.

Accordingly, there is a need for an improved air cushioning sole that provides dynamic cushioning support to the wearer's foot for an extended period of use.

According to some embodiments described herein, articles of footwear of the present disclosure may provide such benefits and improvements by including two independent air cushioning systems defined in a sole that includes an outsole to engage the ground, a midsole disposed above the outsole to support a foot of a wearer, and a heel support member disposed between the midsole and the outsole in a heel region of the sole. The sole includes a plurality of fluidly-connected heel air chambers bounded by the midsole and the heel support member in the heel region of the sole. The sole includes a plurality of fluidly-connected sole air chambers bounded by a bottom surface of the midsole and an upper surface of the outsole. The plurality of sole air chambers is arranged from the heel region of the sole to the forefoot region of the sole to cushion the bottom of the wearer's foot. The plurality of sole air chambers and the plurality of heel air chambers provide different cushioning effects at different zones of the wearer's foot. For example, the plurality of sole air chambers provide a soft underfoot cushioning for impact displacement, while the plurality of heel air chambers provide stability around the wearer's heel.

Figure 3:
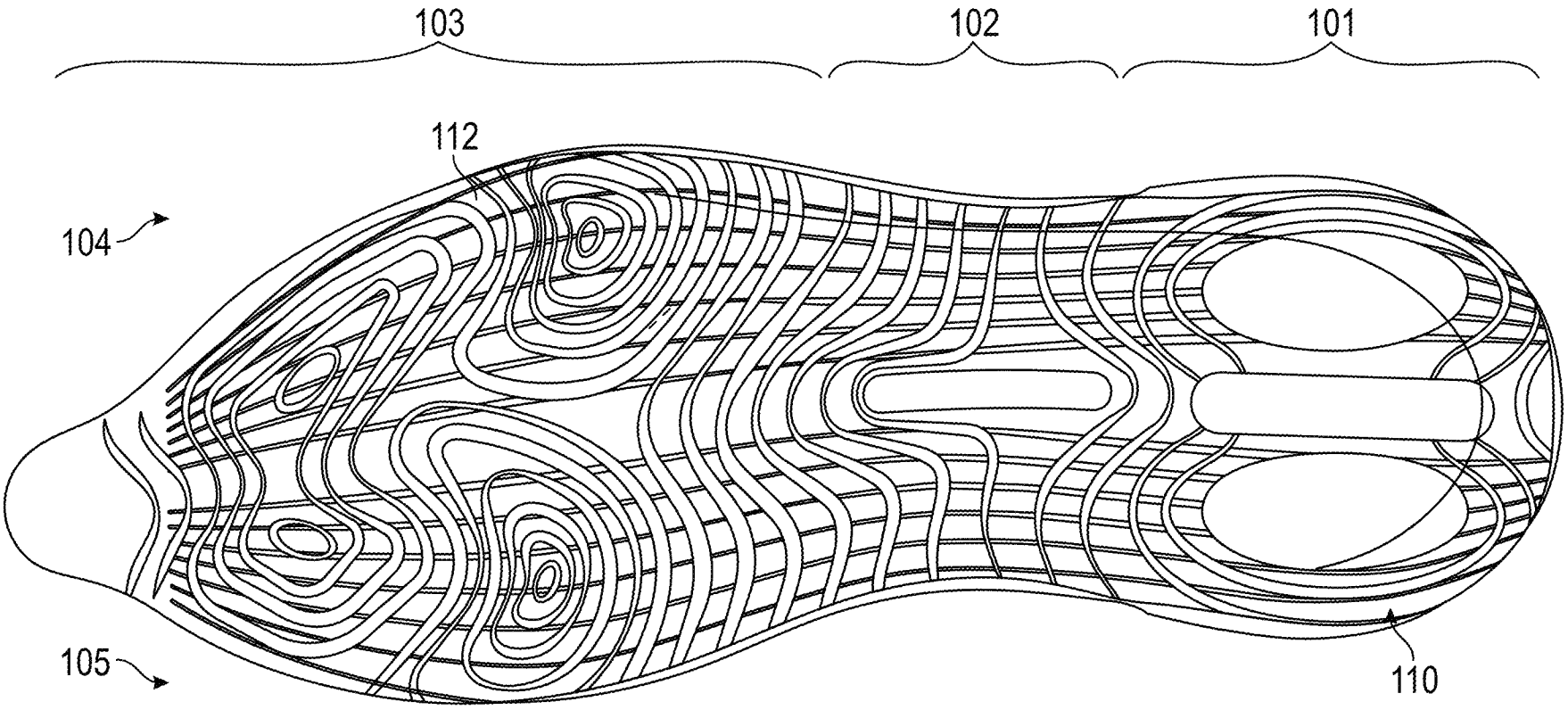
FIG. 3 shows a bottom view of the article of footwear shown in FIG. 1.
Figure 4:
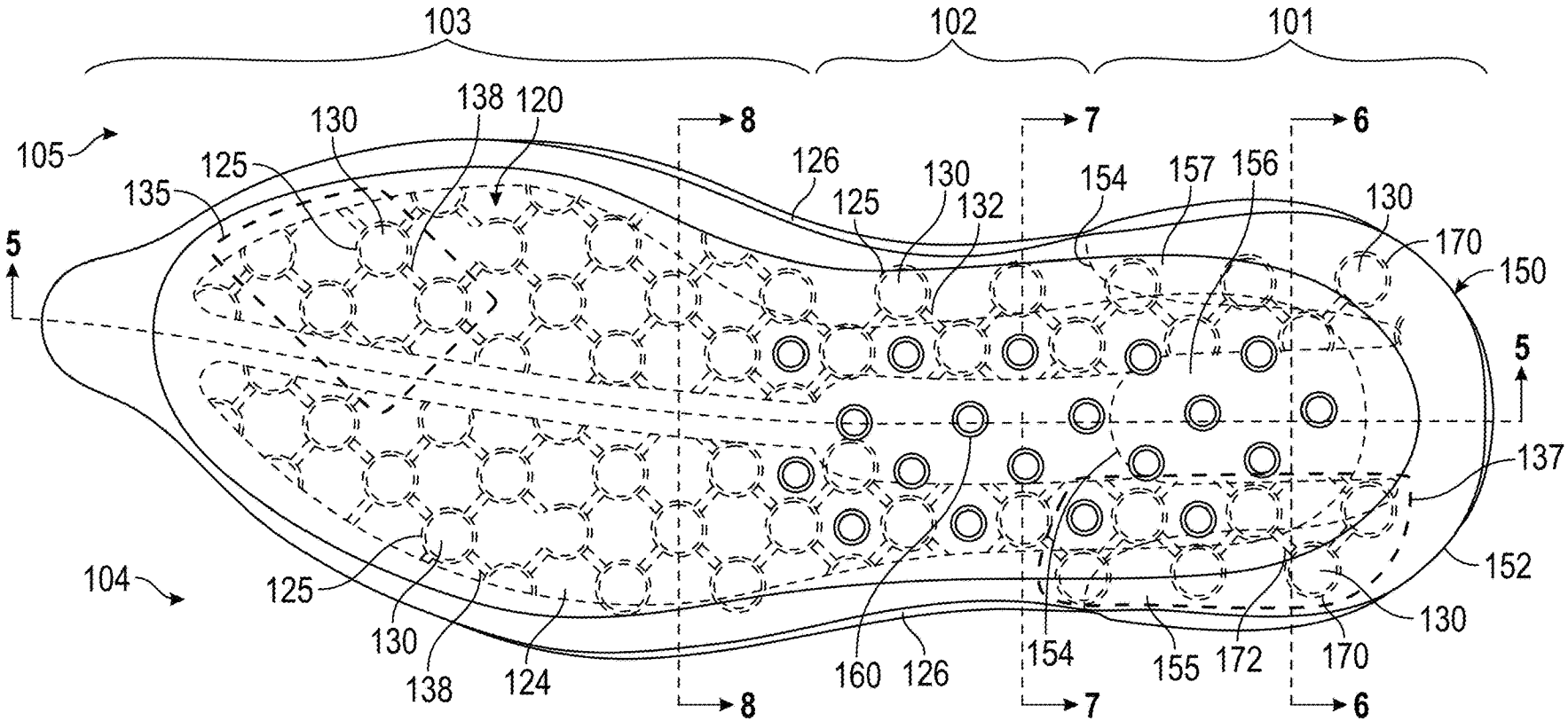
FIG. 4 shows a top view of the sole of the article of footwear shown in FIG. 1.

FIG. 1 illustrates an article of footwear 10 having an upper 20 and a sole 100 coupled to the upper 20 according to one embodiment of the present disclosure. As shown in FIGS. 3 and 4, sole 100 may include a heel region 101, a midfoot or arch region 102, and a forefoot region 103 extending between a lateral side 104 and a medial side 105 of sole 100. Sole 100 may include an insole configured to receive a wearer's foot. Sole 100 may include an outsole 110 configured to engage the ground. Sole 100 may include a midsole 120 disposed above outsole 110 and configured to support a foot of a wearer. Sole 100 may include a heel support member 150 disposed between midsole 120 and outsole 110 in a heel region 101 of sole 100.

Sole 100 may include two independent air cushioning systems to provide a desired cushioning effect for the wearer's foot. For example, sole 100 may include a plurality of fluidly-connected sole air chambers 130 bounded by a bottom section of midsole 120 (e.g., bottom depressions 125) and outsole 110 to absorb shock and cushion the bottom of the wearer's foot. Sole 100 may include a plurality of fluidly-connected heel air chambers 140 bounded by midsole 120 and heel support member 150 in heel region 101 of sole 100 to support the heel of the wearer's foot, thereby stabilizing lateral or rolling motion of the wearer's foot. The plurality of sole air chambers 130 are fluidly isolated from the plurality of heel air chambers 140 such that airflow between the plurality of sole air chambers 130 do not influence or compromise the airflow between the plurality of heel air chambers 140. The combination of the plurality of fluidly-connected sole air chambers 130 and the plurality of fluidly-connected heel air chambers 140 allow sole 100 to cushion the bottom of the wearer's foot while ensuring stability against inadvertent heel movement by the wearer's foot.

In some embodiments, outsole 110 may extend from heel region 101 to forefoot region 103 of sole 100. Outsole 110 may include a bottom surface 112 configured to contact to contact the ground and provide traction for the wearer. Outsole 110 may include an upper surface 114 located opposite to bottom surface 112. Outsole 110 may include a thickness defined between bottom surface 112 and upper surface 114 suitable for stabilizing the wearer's foot, for example, a thickness in a range from 1.5 mm to 5 mm, such as 2.0 to 3.5 mm. Outsole 110 may be formed of a wear-resistant material. For example, the wear-resistant material for outsole 110 may include synthetic or natural rubber, thermoplastic, or a combination thereof.

Figure 5:
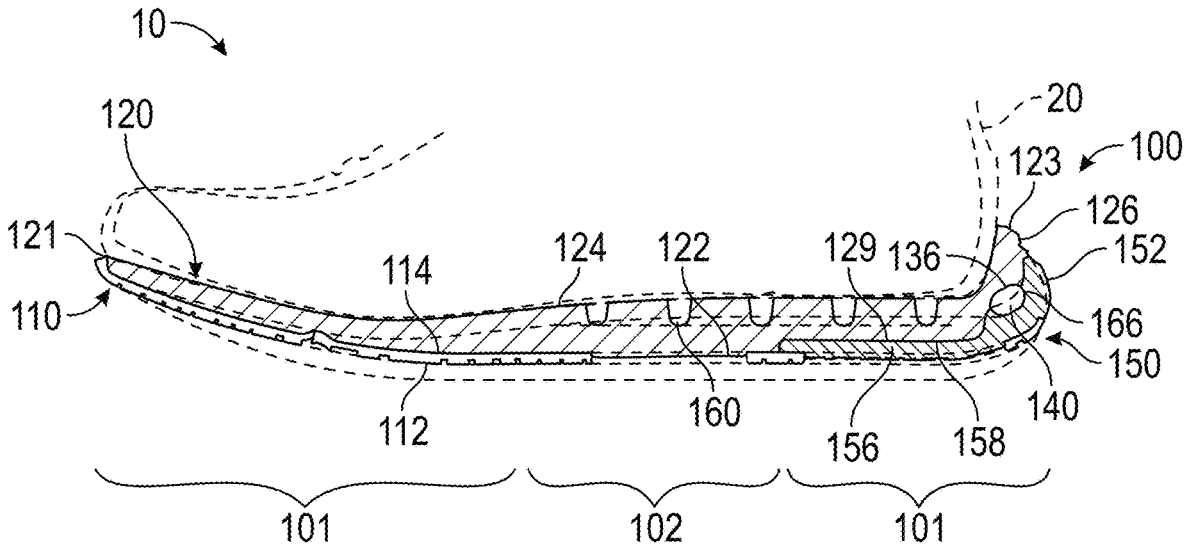
FIG. 5 shows a cross-section view of the sole of the article of footwear taken along line 5-5 in FIG. 4.

In some embodiments, as shown in FIG. 5, midsole 120 may extend from heel region 101 to forefoot region 103 of sole 100. With reference to FIGS. 5-8, midsole 120 may include a bottom surface 122 facing upper surface 114 of outsole 110, whereby bottom surface 122 of midsole 120 is disposed on upper surface 114 of outsole 110. Bottom surface 122 may extend from a front end 121 of midsole 120 in forefoot region 103 and terminate at one or more locations along midfoot region 102 or heel region 101. With reference to FIG. 5, midsole 120 may include a back end 123 disposed behind upper 20 in heel region 101 of sole 100 to provide cushion and support for the heel of a wearer. Midsole 120 may include an upper surface 124 extending from front end 121 of midsole 120 in forefoot region 103 to back end 123 of midsole 120 in heel region 101 of sole 100. Upper surface 124 may be concave-shaped such that midsole 120 is configured to cradle the foot of the wearer.

Figure 7:
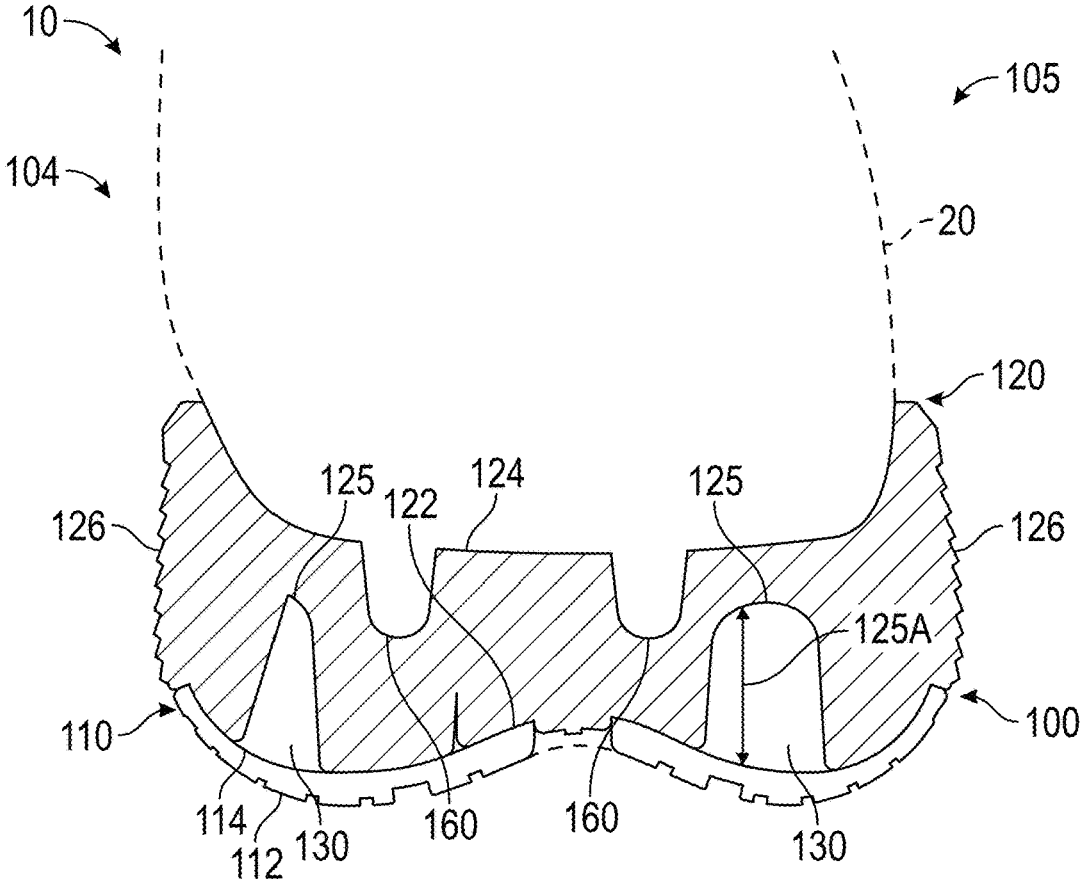
FIG. 7 shows a cross-section view of the sole of the article of footwear taken along line 7-7 in FIG. 4.
Figure 8:
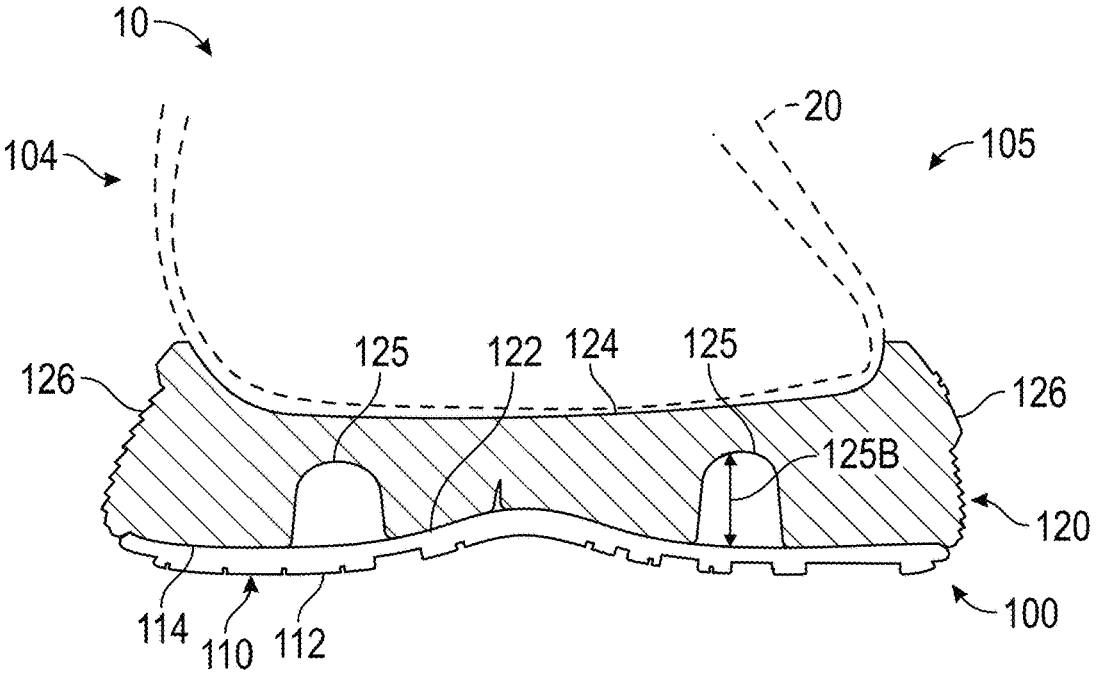
FIG. 8 shows a cross-section view of the sole of the article of footwear taken along line 8-8 in FIG. 4.

With reference to FIGS. 1, 7, and 8, midsole 120 may include an exterior side surface 126 extending in a vertical direction from bottom surface 122 to upper surface 124. Exterior side surface 126 may define a sidewall of sole 100. For example, exterior side surface 126 may extend along lateral side 104 of sole 100 to define a lateral sidewall. Exterior side surface 126 may extend along medial side 105 of sole 100 to define a medial sidewall. Exterior side surface 126 may extend around heel region 101 of sole 100 from medial side 105 to lateral side 104 of sole 100. For example, exterior side surface 126 may extend along back end 123 of midsole 120.

Midsole 120 may be formed of a foam material, such that the midsole 120 is configured to absorb shock and provide cushion to wearer's foot. In some embodiments, midsole 120 may be formed of a foam-based material that includes ethylene vinyl acetate (EVA). In some embodiments, midsole 120 may be formed of a foam-based material that includes materials, such as elastomers, thermoplastic elastomers (e.g., polyether block amide), foam-like plastic, and gel-like plastics. In some embodiments, midsole 120 may be formed of an open-cell foam-based material or a closed-cell foam-based material. In some embodiments, the foam-based material of midsole 120 may have a first durometer in a range between 100 Shore A and 700 Shore A to provide a soft comfortable feel for the wearer's foot.

As shown in FIGS. 7 and 8, bottom surface 122 of midsole 120 may define a plurality of bottom depressions 125 indented into midsole 120. One or more of depressions 125 may be circular or ovular horizontal cross-sectional shape. One or more depressions 125 may have a concave surface extending toward upper surface 124 of midsole 120 to allow depression 125 to deflect or flex when compressive force is applied by the wearer's foot striking the ground, ultimately providing a desired cushioning effect for the wearer's foot. The opening of each bottom depression 125 along bottom surface 122 of midsole 120 may be covered by outsole 110 such that outsole 110 and depression 125 of midsole 120 collectively bound a respective sole air chamber 130. The interface defined between midsole 120 and outsole 110 located around depression 125 may be sealed, while chamber 130 may be fluidly connected to other chambers 130 to form a sealed network of interconnected chambers 130 spaced evenly throughout sole 100. The sealed arrangement between outsole 110 and depression 125 allows sole air chamber 130 to hold air above ambient pressure levels (e.g., 3 psi to 8 psi above ambient pressure), thereby allowing each sole air chamber 130 to absorb shock effectively upon foot strike. When filled with air above ambient pressure, the pressure may impart additional strength to help maintain the shape and structure of depression 125 under the compression of a foot strike, thereby contributing to its support and resilience.

The spatial arrangement and number of bottom depressions 125 may be tuned to provide a desired cushioning effect to the wearer's foot. With reference to FIG. 4, the plurality of bottom depressions 125 are shown schematically in broken lines for showing the spatial arrangement of bottom depressions 125 along sole 100. Two or more bottom depressions 125 may be disposed in a linear arrangement to form a row extending from lateral side 104 to medial side 105 of sole 100. In some embodiments, the plurality of bottom depressions 125 may be arranged in a series of rows arranged from heel region 101 to forefoot region 103 of sole 100.

The size (e.g., diameter and height) of bottom depressions 125 may be varied to provide a desired cushioning effect to the wearer's foot. For example, in some embodiments, the diameter and/or width of bottom depressions 125 may generally decrease from the heel region 101 to the forefoot region 103. For example, as shown in FIG. 7, one or more bottom depressions 125 in midfoot region 102 may include a first height 125A, and as shown in FIG. 8, one or more depressions 125 in forefoot region 103 may include a second a second height 125B that is less than the first height 125A, thereby providing increased cushioning for the arch and heel of the wearer's foot.

The plurality of sole air chambers 130 may be fluidly connected to provide dynamic cushioning that complements the motion of the wearer's foot. For example, with reference to FIG. 4, sole 100 may include a plurality of sole channels 138 (shown schematically in broken line for showing the spatial arrangement of sole channels 138 along sole 100) arranged along sole 100 to interconnect the plurality of sole air chambers 130. For example, each sole channel 138 may extend between a pair of adjacent bottom depressions 125 to interconnect the sole air chambers 130.

In some embodiments, each of one or more sole air chambers 130 located in an interior region of sole 100 (e.g., a first set of sole air chambers 130) may be interconnected to four adjacent sole air chambers 130 via four sole channels 138 that each extend from the same depression 125 to a respective adjacent depression 125. In some embodiments, each of one or more sole air chambers 130 located along a perimeter of sole 100, such as sole air chambers 130 located along lateral side 104 and air chambers 130 located along medial side 105 of sole 100, may be interconnected to only one or two adjacent sole air chambers 130. The additional number of sole channels 138 located in the interior region of sole 100 (e.g., four sole channels 138 associated with each sole air chamber 130) allows air to flow throughout the sole 100 at an effective rate that provides desired cushioning underneath the wearer's foot. The plurality of depressions 125 may be spaced evenly throughout at least forefoot region 103 of sole 100 such that sole air chambers 130 are distributed consistently throughout sole 100 and interconnected by channels 138, thereby providing air cushioning throughout sole 100. For example, the plurality of depressions 125 may be spaced evenly throughout sole 100 from forefoot region 103 to heel region 101.

With reference to FIG. 4, sole channels 138 may all extend at an oblique angle with respect to the longitudinal direction of sole 100 and a transverse direction of sole 100. The spatial arrangement of sole channels 138 promotes air flow simultaneously in both the longitudinal direction of sole 100 and the transverse direction of sole 100 during footstrike, thereby allowing midsole 120 to apply air cushioning support responsively to impact of the wearer's foot.

Figure 6:
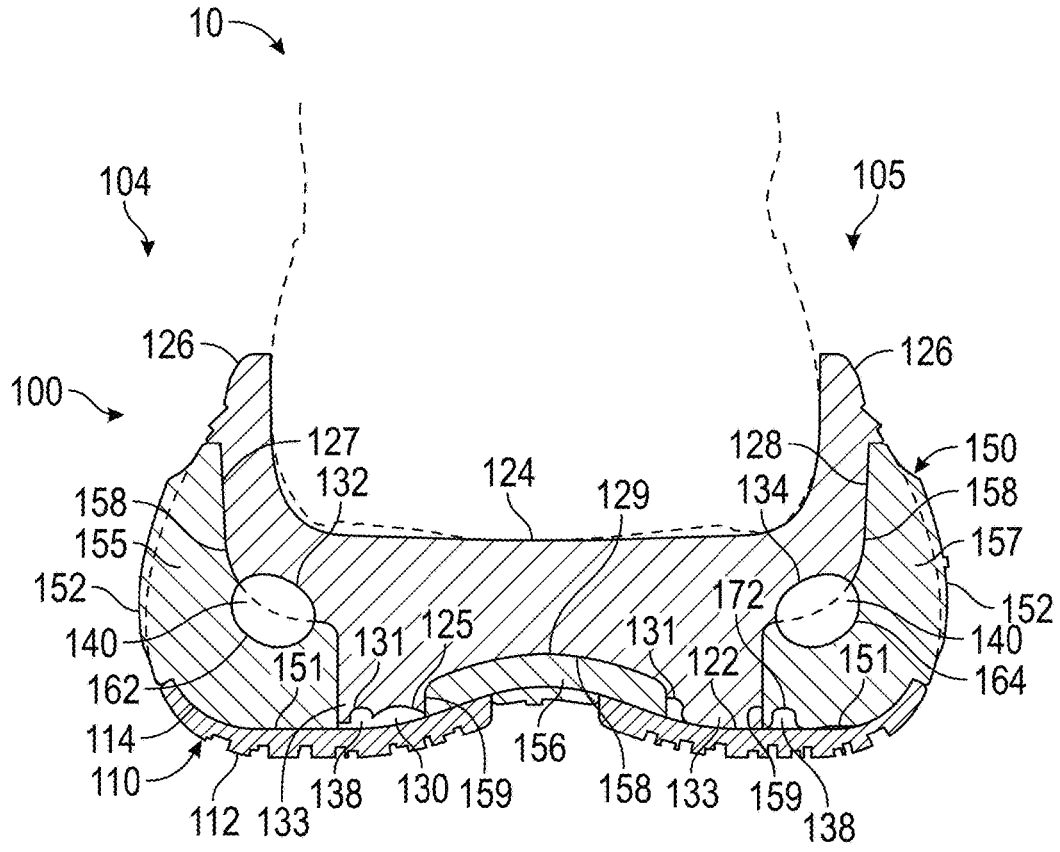
FIG. 6 shows a cross-section view of the sole of the article of footwear taken along line 6-6 in FIG. 4.

The plurality of sole channels 138 are sealed between outsole 110 and midsole 120. In some embodiments, as shown in FIG. 6, the plurality of sole channels 138 may be defined on the bottom surface 122 of midsole 120, such as a groove 131 molded or etched into bottom surface 122, which is bounded by upper surface 114 of outsole 110. In some embodiments, the plurality of sole channels 138 may be defined on the upper surface 114 of outsole 110, such as a groove molded or etched into outsole 110, which is bounded by bottom surface 122 of midsole 120.

In some embodiments, midsole 120 may define fluidly isolated networks of sole air chambers 130 located in different areas of sole 100 to provide tailored cushioning and energy returns in areas subjected to particular force during an activity, such as running or hiking. For example, midsole 120 may define a first network (e.g., a forefoot network corresponding to area 135) in forefoot region 103 and a second network (e.g., a heel network corresponding to area 137), where there are no chambers or channels connecting the first and second networks. The first network of sole air chambers 130 located in area 135 may be fluidly connected by a first network of sole channels 138. The second network of sole air chambers 130 located in area 137 may be fluidly connected by a second network of sole channels 138. For example, the first network of sole air chambers 130 located in forefoot region 103 may be positioned toward medial side 105 of midsole 120, and the second network of sole air chambers 130 located in heel region 105 may be positioned toward lateral side 104 of the midsole 120, as indicated in FIG. 4, to align with and accommodate forces experienced during running, hiking, or other activities. The midsole 120 may not define any sole air chambers 130 in the remaining area of midsole 120 located beyond areas 135 and 137 of midsole 120.

In some embodiments, midsole 120 may include one or more recessed surfaces (e.g., a first recessed surface 127, a second recessed surface 128, and a third recessed surface 129) located in a heel region 101 of sole 100 to define a space for receiving heel support member 150. The one or more recessed surfaces of midsole 120 may define a concavity (e.g., a first concavity 132, a second concavity 134, and a third concavity 136) indented into the one or more recessed surfaces of midsole 120 to partially define the plurality of heel air chambers 140 bounded by midsole 120 and heel support member 150.

For example, as shown in FIG. 6, midsole 120 may include a first recessed surface 127 extending from exterior side surface 126 along lateral side 104 of sole 100 to bottom surface 122 of midsole 120. First recessed surface 127 may recede into midsole 120 away from exterior side surface 126 along lateral side 104 of sole 100 and bottom surface 122. First recessed surface 127 may include a convex portion that protrudes toward lateral side 104 of sole 100. First recessed surface 127 may define a first midsole concavity 132 indented into first recessed surface 127. For example, first midsole concavity 132 may be indented into first recessed surface 127 along the convex portion of first recessed surface 127.

With reference to FIG. 6, midsole 120 may include a second recessed surface 128 extending from exterior side surface 126 along lateral side 104 of sole 100 to bottom surface 122 of midsole 120. Second recessed surface 128 may recede into midsole 120 away from exterior side surface 126 along medial side 105 of sole 100 and bottom surface 122. Second recessed surface 128 may include a convex portion that protrudes toward medial side 105 of sole 100. Second recessed surface 128 may define a second midsole concavity 134 indented into second recessed surface 128. For example, second midsole concavity 134 may be indented into second recessed surface 128 along the convex portion of second recessed surface 128.

As shown in FIGS. 5 and 6, midsole 120 may include a third recessed surface 129 extending from exterior side surface 126 along back end 123 of midsole 120 to bottom surface 122 of midsole 120. Third recessed surface 129 may recede into midsole 120 away from exterior side surface 126 along back end 123 of midsole 120 and bottom surface 122. Third recessed surface 129 may be located in a central portion of sole 100 such that third recessed surface 129 is disposed between first recessed surface 127 and second recessed surface 128. Third recessed surface 129 may include a convex portion that protrudes toward back end 123 of midsole 120. Third recessed surface 129 may define a third midsole concavity 136 indented into third recessed surface 129. For example, third midsole concavity 136 may be indented into third recessed surface 129 along the convex portion of third recessed surface 129. In some embodiments, midsole 120 may define additional concavities on first, second, and third recessed surfaces 127-129 to form more heel air chambers 140 in sole 100.

With reference to FIGS. 4 and 5, upper surface 124 of midsole 120 may define a plurality of upper depressions 160 indented into midsole 120. One or more of upper depressions 160 may be cylindrical-shaped and have a concave surface extending toward bottom surface 122 of midsole 120 to allow depression 160 to deflect or flex when compressive force is applied by the wearer's foot striking the ground. In some embodiments, the openings of upper depressions 160 disposed along upper surface 124 of midsole 120 may be covered the insole of sole 100. In some embodiments, upper depressions 160 are filled with ambient air.

Similar to bottom depressions 125, the spatial arrangement and number of upper depressions 160 may be tuned to provide a desired cushioning effect to the wearer's foot. With reference to FIG. 4, all upper depressions 160 may be arranged in a central region of sole 100 and disposed entirely in heel region 101 and midfoot region 102 of sole 100.

As shown FIGS. 5 and 6, heel support member 150 may be received between outsole 110 and one or more recessed surfaces (first, second, and third recessed surface 127-129) of midsole 120 to provide additional stability for the heel of the wearer's foot. Heel support member 150 may include a bottom surface 151 disposed on upper surface 114 of outsole 110.

Heel support member 150 may be formed of a stiff material, such that the heel support member 150 stabilizes heel region 101 of sole 100. In some embodiments, heel support member 150 may be formed of a thermoplastic or thermoset material, such as an injected molded polyurethane. In some embodiments, the material of heel support member 150 may have a second durometer in a range between 700 Shore A and 1000 Shore A, such as 800 Shore A and 95° Shore A, to provide sufficient rigidity to stabilize heel region 101 of sole 100. The second durometer of heel support member 150 is greater than the first durometer of midsole 120 such that midsole 120 provides softer cushioning underneath the wearer's foot while heel support member 150 stabilizes the sides of sole 100 in heel region 101.

Figure 2:
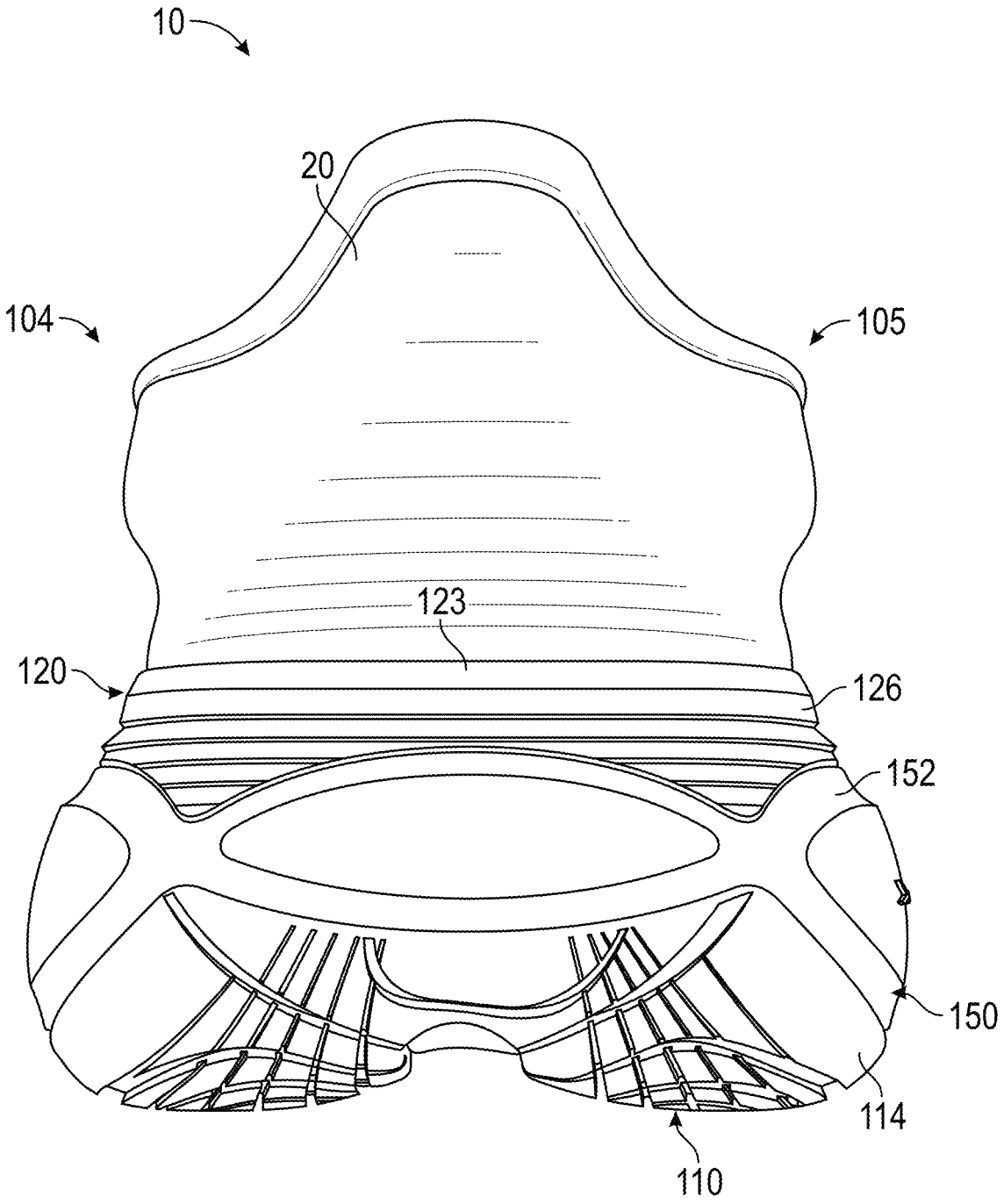
FIG. 2 shows a rear view of the article of footwear shown in FIG. 1.

With reference to FIGS. 1, 2, and 4 (showing heel support member 150 schematically in broken lines for simplicity), heel support member 150 may be located entirely in heel region 101 of sole 100. Heel support member 150 may include a convex-shaped exterior surface 152 extending along lateral side 104 of sole 100 and along medial side 105 of sole 100, such that exterior surface 152 of heel support member 150 forms part of lateral sidewall and medial sidewall of sole 100. Exterior surface 152 of heel support member 150 may extend around back end 123 of midsole 120 from lateral side 104 to medial side 105 of sole 100. By extending around heel region 101 of sole 100, heel support member 150 is configured to restrict lateral or medial movement of the wearer's heel.

As shown in FIG. 4, heel support member 150 may include a curved interior surface 154 to form an interlocking fit with midsole 120. For example, interior surface 154 may define a lateral extension 155 of heel support member 150 disposed on lateral side 104 of sole 100, a medial extension 157 of heel support member 150 disposed on medial side 105 of sole 100, and a central extension 156 of heel support member 150 disposed between lateral extension 155 and medial extension 157. Exterior surface 152 of heel support member may extend from an end of lateral extension 155 to an end of medial extension 157 such that lateral, central, and medial extensions 155-157 of heel support member 150 merge at the back of heel region 101 of sole 100. Midsole 120 may be received between lateral and central extensions 155, 156 of heel support member 150 and between medial and central extensions 157, 156 of heel support member 150.

As shown in FIG. 6, lateral extension 155 of heel support member 150 may be received between first recessed surface 127 of midsole 120 and upper surface 114 of outsole 110. Medial extension 157 of heel support member 150 may be received between second recessed surface 128 of midsole 120 and upper surface 114 of outsole 110. Central extension 156 of heel support member 150 may be received between third recessed surface 129 of midsole 120 and upper surface 114 of outsole 110.

With reference to FIGS. 5 and 6, heel support member 150 may include an upper surface 158 extending along lateral, central, and medial extensions 155-157 of heel support member 150. In some embodiments, upper surface 158 disposed along lateral extension 155 of heel support member 150 may define a concave shape complementary to the convex portion of first recessed surface 127 of midsole 120 such that the convex portion of first recessed surface 127 is disposed flush against upper surface 158 along lateral extension 155 of heel support member 150. Upper surface 158 of heel support member 150 defines a first member concavity 162 that is aligned with first sole concavity 132 of midsole 120 such that first member concavity 162 and first sole concavity 132 collectively bound a respective heel air chamber 140 disposed along lateral side 104 of sole 100.

With reference to FIG. 6, in some embodiments, upper surface 158 disposed along medial extension 157 of heel support member 150 may define a concave shape complementary to the convex portion of second recessed surface 128 of midsole 120 such that the convex portion of second recessed surface 128 is disposed flush against upper surface 158 along medial extension 157 of heel support member 150. Upper surface 158 of heel support member 150 may define a second member concavity 164 that is aligned with second sole concavity 134 of midsole 120 such that second member concavity 164 and second sole concavity 134 collectively bound a respective heel air chamber 140 disposed along medial side 105 of sole 100.

With reference to FIG. 5, in some embodiments, upper surface 158 disposed along central extension 156 of heel support member 150 may define a concave shape complementary to the convex portion of third recessed surface 129 of midsole 120 such that the convex portion of third recessed surface 129 is disposed flush against upper surface 158 disposed along central extension 156 of heel support member 150. Upper surface 158 of heel support member 150 may define a third member concavity 166 that is aligned with third sole concavity 136 of midsole 120 such that third member concavity 166 and third sole concavity 136 collectively bound a respective heel air chamber 140 disposed along a back of sole 100 in between lateral side 104 and medial side 105. In some embodiments, upper surface 158 may define additional concavities to form more heel air chambers 140 in sole 100.

Figure 9:
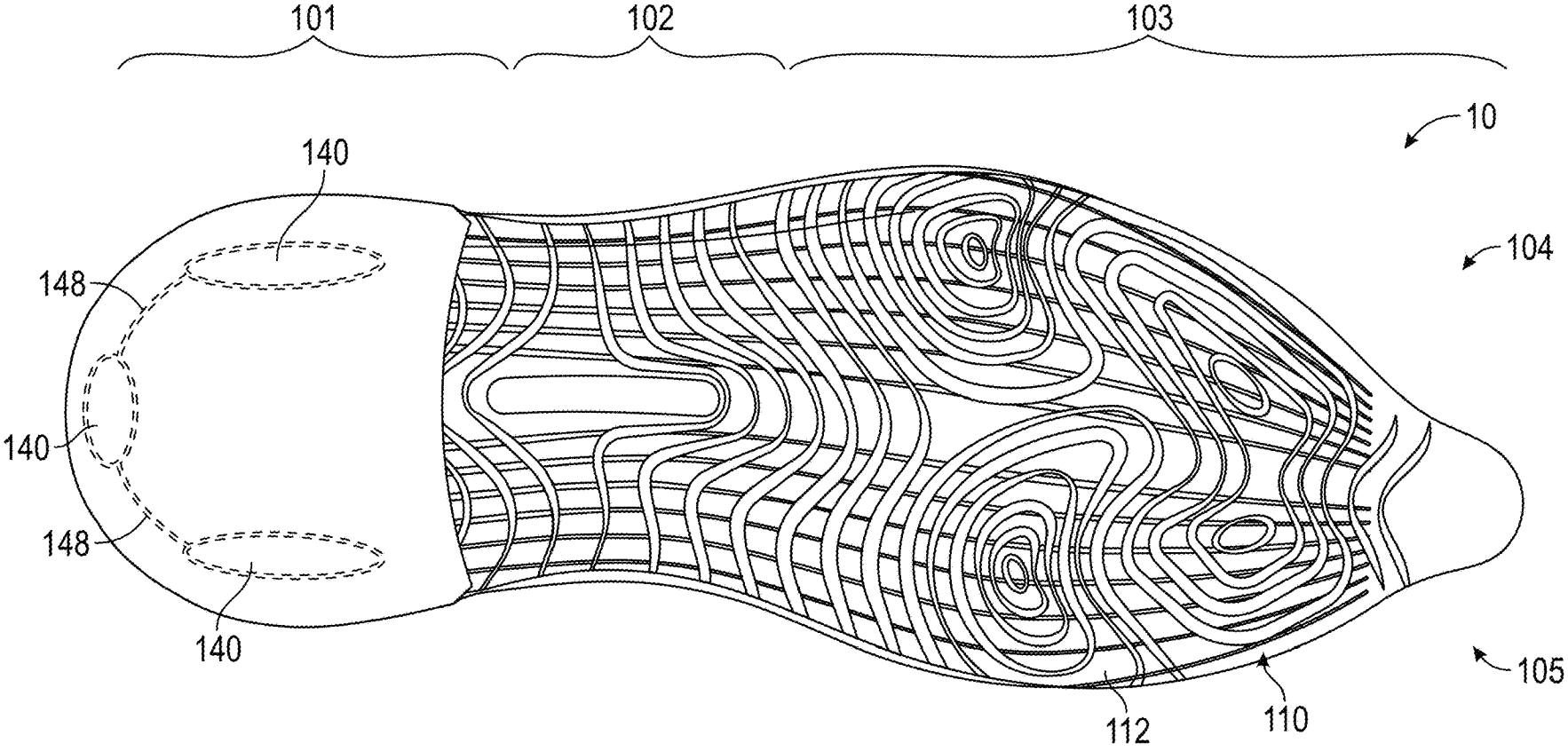
FIG. 9 shows a bottom view of the sole of the article of footwear shown in FIG. 1 with some elements removed.

The plurality of heel air chambers 140 may be fluidly connected to provide dynamic stability that reacts to the motion of the wearer's heel. For example, with reference to FIG. 9, sole 100 may include a plurality of heel channels 148 (shown schematically in broken line for simplicity) arranged in heel region 101 of sole 100 to interconnect the plurality of heel air chambers 140. The plurality of heel channels 148 are sealed between midsole 120 and heel support member 150. In some embodiments, the plurality of heel channels 148 may be defined on the upper surface 158 of heel support member 150, such as a groove molded or etched into upper surface 158, which is bounded by a surface (e.g., first, second, and third recessed surfaces 127-129) of midsole 120. In some embodiments, the plurality of heel channels 148 may be defined on a surface (e.g., first, second, and third recessed surfaces 127-129) of midsole 120, such as a groove molded or etched into midsole 120, which is bounded by upper surface 158 of heel support member 150.

The spatial arrangement of heel air chambers 140 and the fluid communication between the heel air chambers 140 dynamically support the periphery of the wearer's heel. For example, the plurality of heel air chambers 140 include at least one heel air chamber 140 disposed on lateral side 104 of sole 100 and at least one heel air chamber 140 disposed on medial side 105 of sole 100 to provide support on both sides of the wearer's heel, thereby minimizing inadvertent rolling of the wearer's heel. The plurality of heel air chambers 140 include at least one heel air chamber 140 located between lateral side 104 and medial side 105 of heel to allow air to be transferred to either side of sole 100, thereby making heel air chambers 140 more responsive to rapid movement of the wearer's heel.

With reference to FIG. 4, in some embodiments, bottom surface 151 of heel support member 150 may define a bottom depression 170 indented into heel support member 150. Similar to bottom depression 125 of midsole 120, the opening of depression 170 of heel support member 150 may be covered by outsole 110 such that outsole 110 and depression 170 collectively bound a respective sole air chamber 130. With reference to FIG. 6, in some embodiments, bottom surface 151 of heel support member 150 may define a groove 172 indented into heel support member 150 to form a respective sole channel 138 to fluidly connect sole air chamber 130 of depression 170 with sole air chambers 130 defined by bottom depressions 125 of midsole 120. By defining depressions 170 and grooves 172 on bottom surface 151, heel support member 150 allows the plurality of sole air chambers 130 to be arranged to the back of sole 100, thereby providing more cushioning for heel strike motion by the wearer's foot.

In some embodiments, as shown in FIG. 6, heel support member 150 may define one or more openings 159 extending from upper surface 158 to bottom surface 151. Midsole 120 may define one or more protrusions 133 that are each received in a respective opening 159 of heel support member 150 to interlock midsole 120 with heel support member 150, thereby promoting an intimate interface between upper surface 158 of heel support member 150 and the first, second, and third recessed surfaces 127-129 of midsole 120.

In some embodiments, the sole of the article of footwear may include a heel support member that is disposed only along one side of the sole (e.g., the lateral side) to add stability and hinder unwanted movement of the wearer's heel in a particular direction. For example, FIGS. 10-19 illustrate an article of footwear 40 having an upper 50 and a sole 200 coupled to the upper 50. Sole 200 may include a heel region 201, a midfoot or arch region 202, and a forefoot region 203 extending between a lateral side 204 and a medial side 205 of sole 200. Sole 200 may be similar to the other embodiments described herein. For example, sole 200 may include an outsole 210 configured to engage the ground, a midsole 220 disposed above outsole 210 and configured to support a foot of a wearer, and a heel support member 250 disposed between midsole 120 and outsole 210 in a heel region 101 of sole 100. However, with reference to FIG. 19, heel support member 250 may not extend along both lateral side 204 and medial side 205 of sole 200. Rather, heel support member 250 may extend from lateral side 204 of sole 200 to the back of sole 200 and terminate along the back of sole 200, thereby providing additional support to lateral side of sole 200. In some embodiments, heel support member 250 may extend from medial side 205 of sole 200 to the back of sole 200 and terminate along the back of sole 200.

Similar to sole 100 of footwear 10 shown in FIGS. 1-9, sole 200 shown in FIGS. 10-19 includes two independent air cushioning systems: a plurality of fluidly-connected sole air chambers 230 and a plurality of fluidly-connected heel air chambers 240. The plurality of sole air chambers 230 may be bounded by a bottom section of midsole 220 to absorb shock and cushion the bottom of the wearer's foot. The plurality of heel air chambers 140 may be bounded by midsole 220 and heel support member 250 in heel region 201 of sole 100 to support the heel of the wearer's foot, thereby stabilizing lateral or rolling motion of the wearer's foot.

Figure 12:
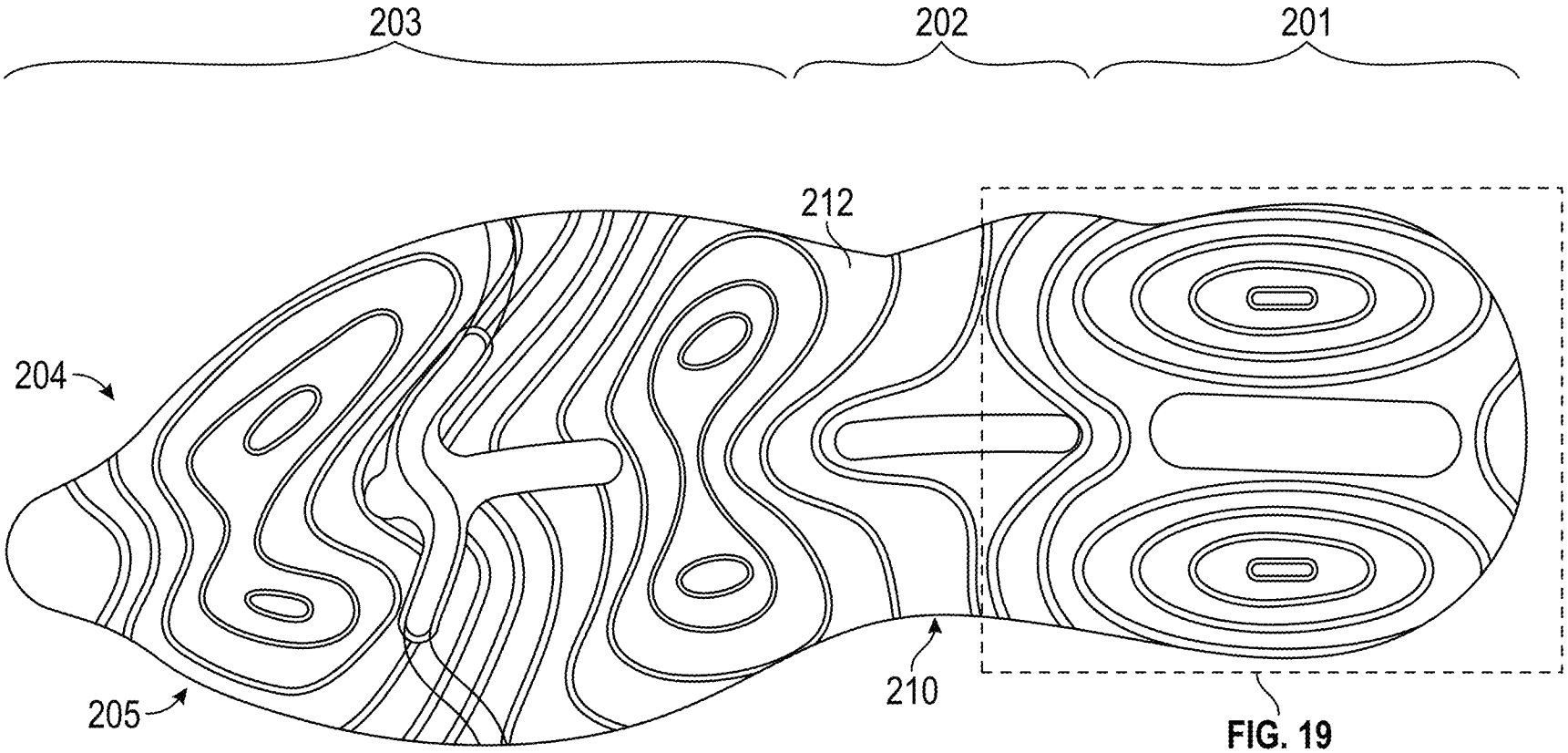
FIG. 12 shows a bottom view of the article of footwear shown in FIG. 10.
Figure 14:
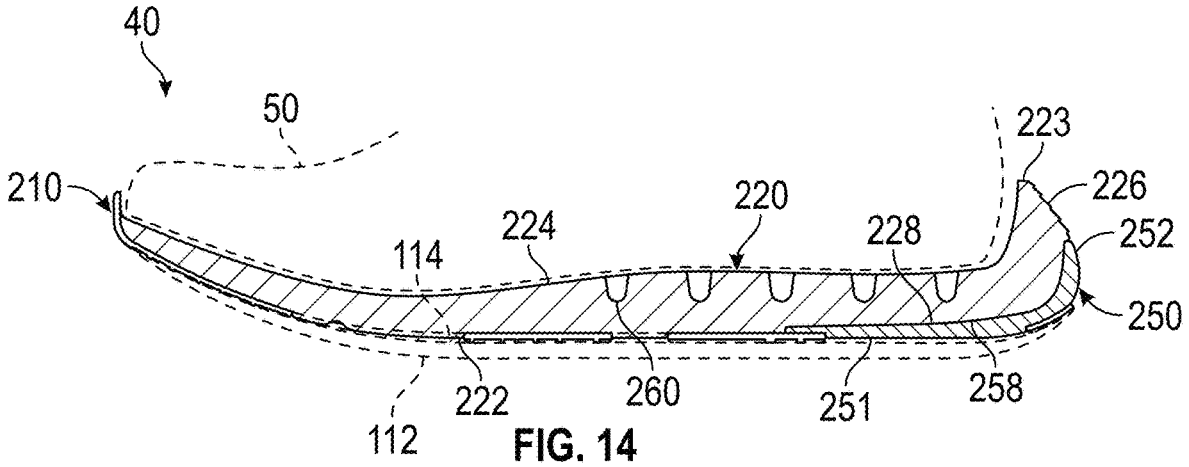
FIG. 14 shows a cross-section view of the sole of the article of footwear taken along line 14-14 in FIG. 13.

As shown in FIGS. 12 and 14, outsole 210 may extend from heel region 201 to forefoot region 203 of sole 200. Outsole 210 may include the same or similar features of outsole 110 shown in FIGS. 1-9. For example, outsole 210 may include may include a bottom surface 212 configured to contact the ground and an upper surface 214 located opposite to bottom surface 212.

Figure 13:
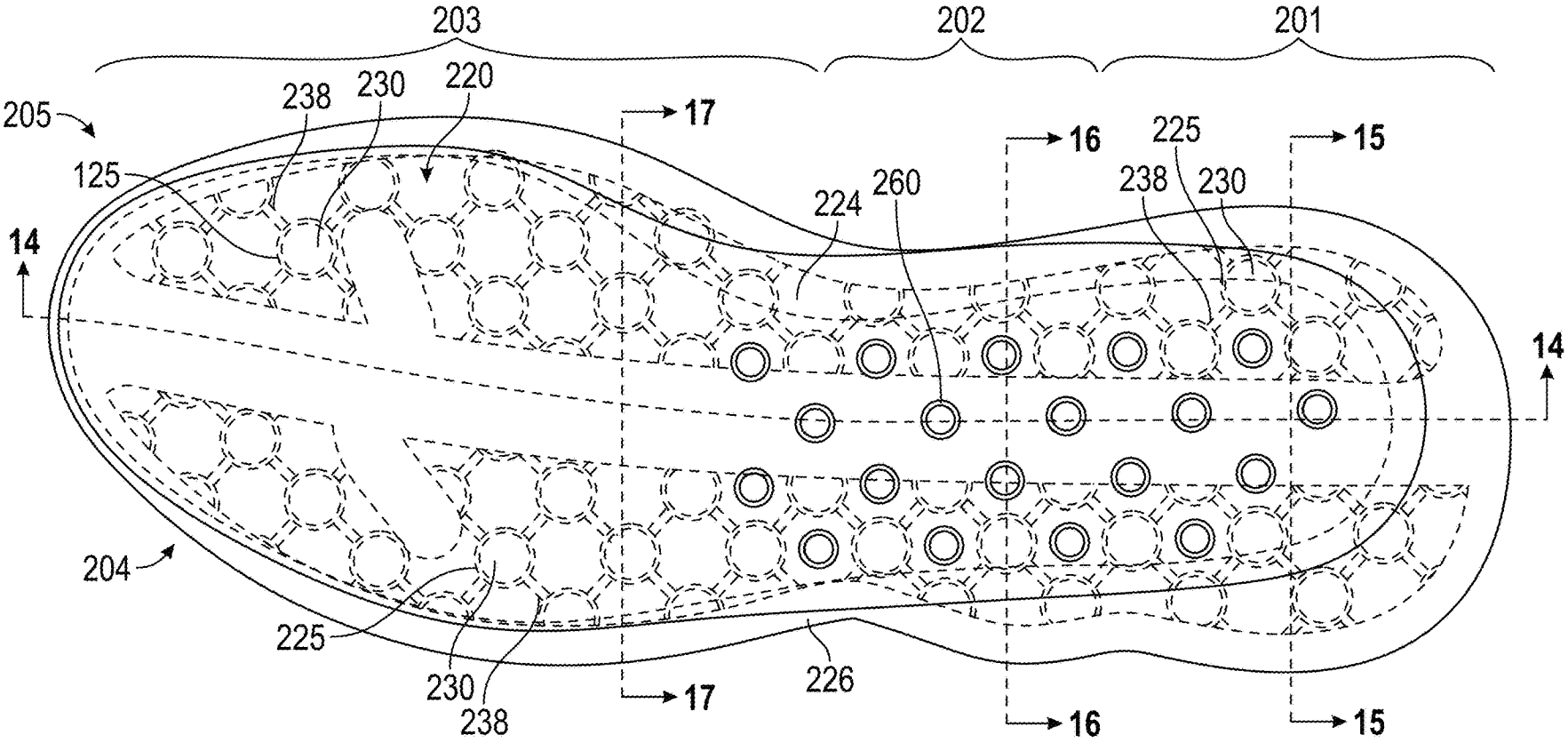
FIG. 13 shows a top view of the sole of the article of footwear shown in FIG. 10.

With reference to FIGS. 13 and 14, midsole 220 may extend from heel region 201 to forefoot region 203 of sole 200. Midsole 220 may include the same or similar features of midsole 220 shown in FIGS. 1-9. For example, midsole 220 may include a bottom surface 222 disposed on upper surface 214 of outsole 210 and an upper surface 224 extending from a front end 221 of midsole 220 in forefoot region 203 to back end 223 of midsole 220 in heel region 201 of sole 200. Midsole 220 may include an exterior side surface 226 extending in a vertical direction from bottom surface 222 to upper surface 224 and extending around heel region 201 of sole 200 from medial side 205 to lateral side 204 of sole 200, such that midsole 220 defines a lateral sidewall and a medial sidewall of sole 200.

Midsole 220 may be formed of a foam material, similar to or the same as the foam material of midsole 120. In some embodiments, midsole 220 may be formed of a foam-based material that includes ethylene vinyl acetate (EVA). In some embodiments, the foam-based material of midsole 220 may have a first durometer in a range between 100 Shore A and 700 Shore A to provide a soft comfortable feel for the wearer's foot.

Figure 15:
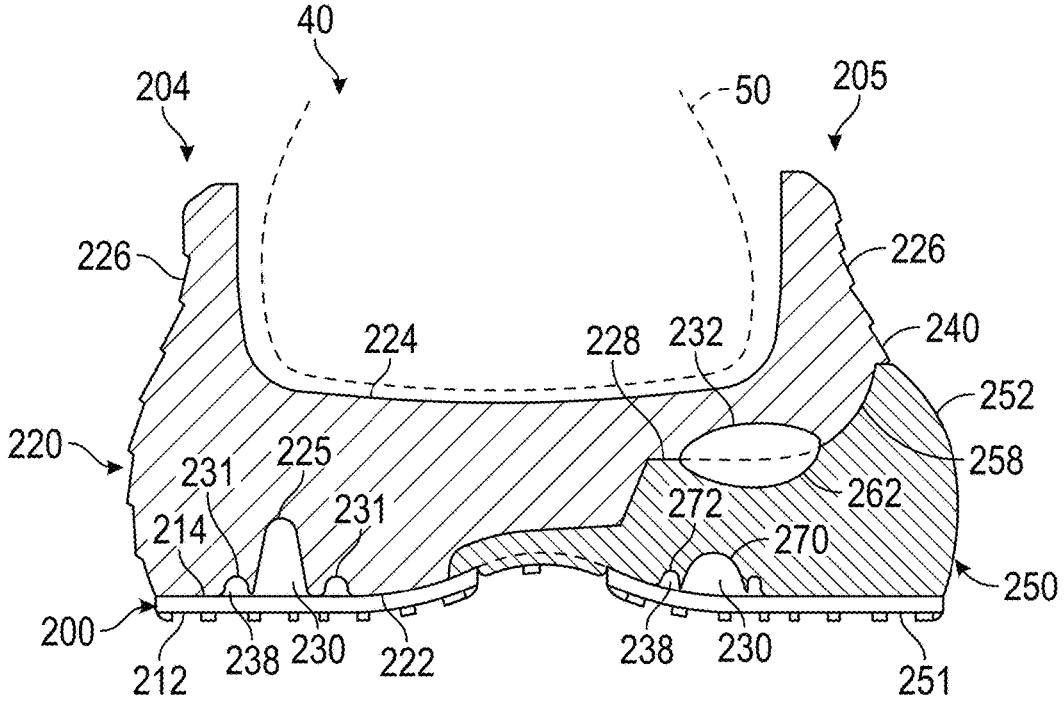
FIG. 15 shows a cross-section view of the sole of the article of footwear taken along line 15-15 in FIG. 13.
Figure 16:
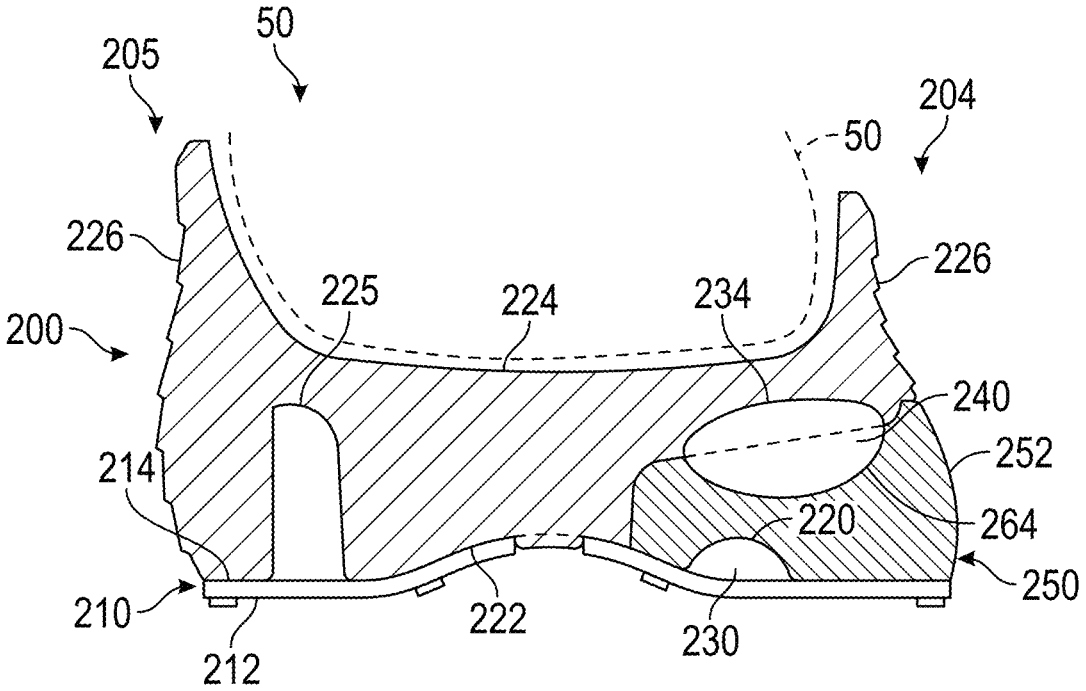
FIG. 16 shows a cross-section view of the sole of the article of footwear taken along line 16-16 in FIG. 13.
Figure 17:
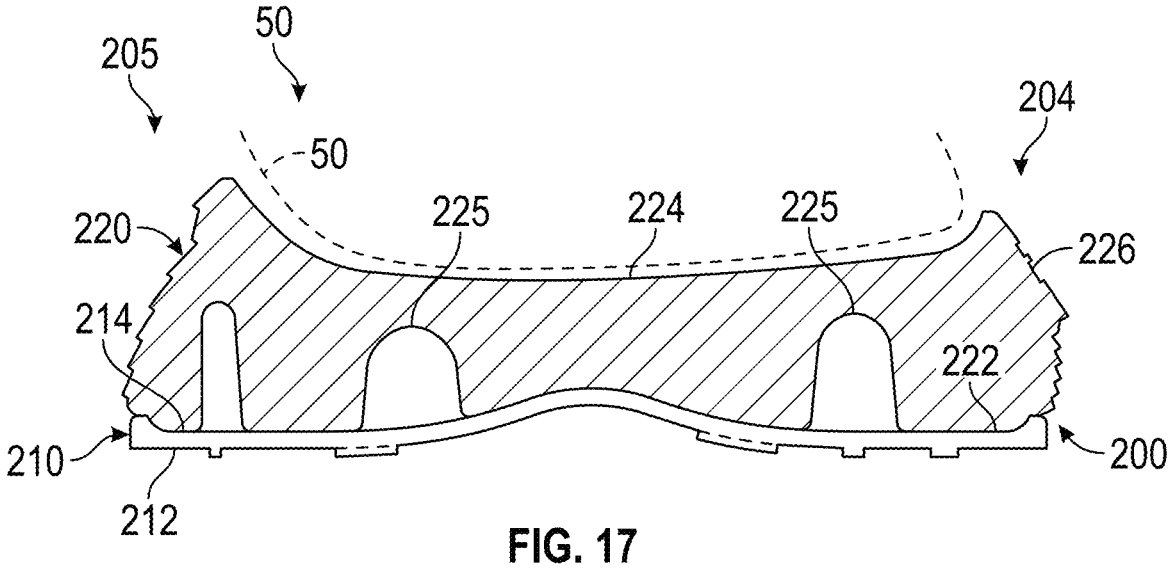
FIG. 17 shows a cross-section view of the sole of the article of footwear taken along line 17-17 in FIG. 13.
Figure 18:
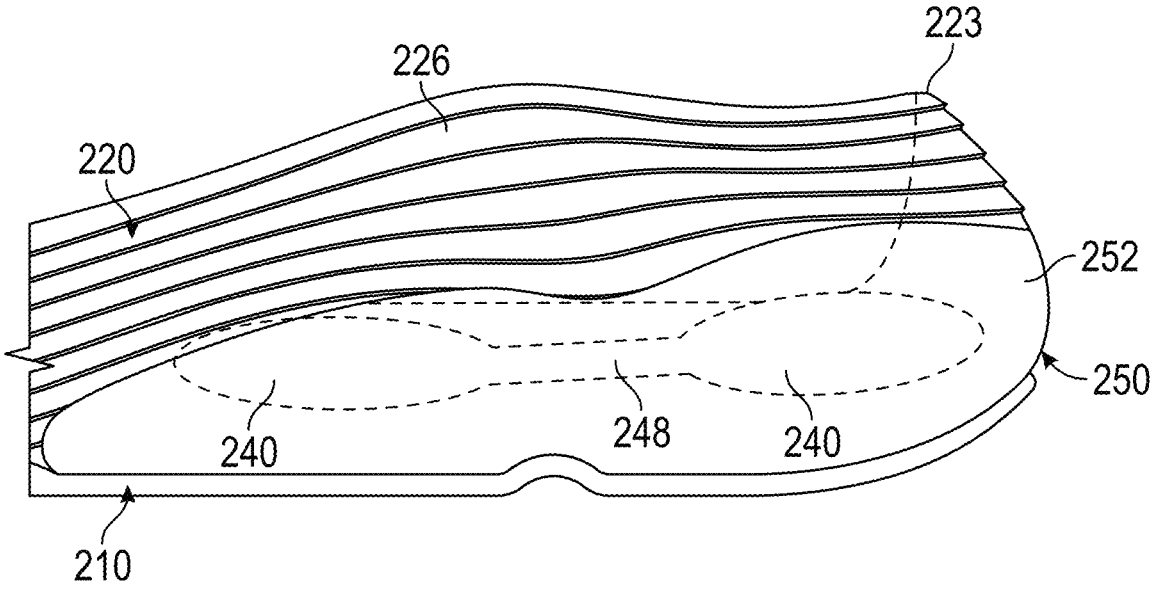
FIG. 18 shows an enlarged side view of a portion of the article of footwear shown in FIG. 10.

As shown in FIGS. 15-17, bottom surface 222 of midsole 220 may define a plurality of bottom depressions 225 indented into midsole 220, similar to or the same as depressions 125. The opening of each bottom depression 225 along bottom surface 222 of midsole 220 may be covered by outsole 210 such that outsole 210 and depression 225 of midsole 120 collectively bound a respective sole air chamber 230. The sealed arrangement between outsole 210 and depression 225 allows sole air chamber 230 to hold air above ambient pressure levels (e.g., 3 psi to 8 psi above ambient pressure) to provide a desired cushioning effect.

With reference to FIG. 13, the plurality of bottom depressions 225 are shown schematically in broken lines for showing the spatial arrangement of bottom depressions 225 along sole 200. Two or more bottom depressions 225 may be disposed in a linear arrangement to form a row extending from lateral side 204 to medial side 205 of sole 200. In some embodiments, the plurality of bottom depressions 225 may be arranged in a series of rows arranged from heel region 201 to forefoot region 203 of sole 200. The spatial arrangement of bottom depressions 225 allows midsole 220 to cushion the entire foot of the wearer. Similar to bottom depressions 125 of sole midsole 120, the size and dimensions of bottom depressions 225 of midsole 220 may be varied to provide a desired cushioning effect to the wearer's foot. For example, in some embodiments, the diameter and/or height of bottom depressions 225 may generally decrease from the heel region 201 to the forefoot region 203.

Similar to the plurality of sole air chambers 130 of sole 100, the plurality of sole air chambers 230 may be fluidly connected to provide dynamic cushioning that complements the motion of the wearer's foot. For example, with reference to FIG. 13, sole 200 may include a plurality of sole channels 238 (shown schematically in broken line for showing the spatial arrangement of sole channels 138 along sole 100) arranged along sole 200 to interconnect the plurality of sole air chambers 230. For example, each sole channel 138 may extend between a pair of adjacent bottom depressions 225 to interconnect the sole air chambers 230. In some embodiments, one or more sole air chambers 230 located in an interior region of sole 200 may be interconnected to four adjacent sole air chambers 230 via four sole channels 238 extending from the same depression 225 to a respective adjacent depression 225. In some embodiments, one or more sole air chambers 230 located along a perimeter of sole 200, such as sole air chambers 230 located along lateral side 204 and sole air chambers 230 located along medial side 205 of sole 200, may be interconnected to only one or two adjacent sole air chambers 230.

The plurality of sole channels 238 are sealed between outsole 210 and midsole 220. In some embodiments, the plurality of sole channels 238 may be defined on the bottom surface 222 of midsole 220, such as a groove molded or etched into bottom surface 222, which is bounded by upper surface 214 of outsole 210. In some embodiments, the plurality of channels 238 may be defined on the upper surface 214 of outsole 210.

With reference to FIGS. 13 and 14, upper surface 224 of midsole 220 may define a plurality of upper depressions 260 indented into midsole 220. Upper depressions 260 may have the same or similar properties of upper depressions 160 of midsole 120. For example, upper depression 260 may be cylindrically-shaped and filled with ambient air.

With reference to FIGS. 14-16, midsole 220 include a recessed surface 228 located in heel region 202 of sole 200 to define a space for receiving heel support member 250. Recessed surface 228 may extend from exterior side surface 226 along lateral side 204 of sole 200 to bottom surface 222 of midsole 220. Recessed surface 228 may recede into midsole 220 away from exterior side surface 226 along lateral side 204 of sole 200 and bottom surface 222. Recessed surface 228 may include a convex portion that protrudes toward lateral side 204 of sole 200.

Recessed surface 228 may define one or more concavities that define at least a portion of heel air chambers 240. For example, as shown in FIG. 15, recessed surface 228 may define a first midsole concavity 242 indented into recessed surface 228. First midsole concavity 242 may be indented into midsole 220 along the convex portion of recessed surface 228. As shown in FIG. 16, recessed surface 228 may define a second midsole concavity 244 indented into recessed surface 228. First and second midsole concavities 242 and 244 may each be located adjacent to lateral side 204 of sole 204, but second midsole concavity 244 may be disposed closer to midfoot region 202 than first midsole concavity 242.

As shown FIGS. 14-16, heel support member 250 may be received between outsole 210 and recessed surface 228 of midsole 220 to provide additional stability for the lateral side of wearer's heel. Heel support member 250 may include a bottom surface 251 disposed on upper surface 114 of outsole 110.

Similar to heel support member 150 of sole 100, heel support member 250 may be formed of a stiff material, such as a thermoplastic or thermoset material, for example, an injected molded polyurethane. In some embodiments, the material of heel support member 250 may have a second durometer in a range between 700 Shore A and 1000 Shore A, such as 800 Shore A and 95° Shore A, to provide sufficient rigidity that stabilizes lateral side 204 of heel region 201 of sole 200. The second durometer of heel support member 250 is greater than the first durometer of midsole 220 such that midsole 220 provides softer cushioning underneath the wearer's foot while heel support member 250 stabilizes lateral side 204 of sole 200 in heel region 201.

Figure 10:
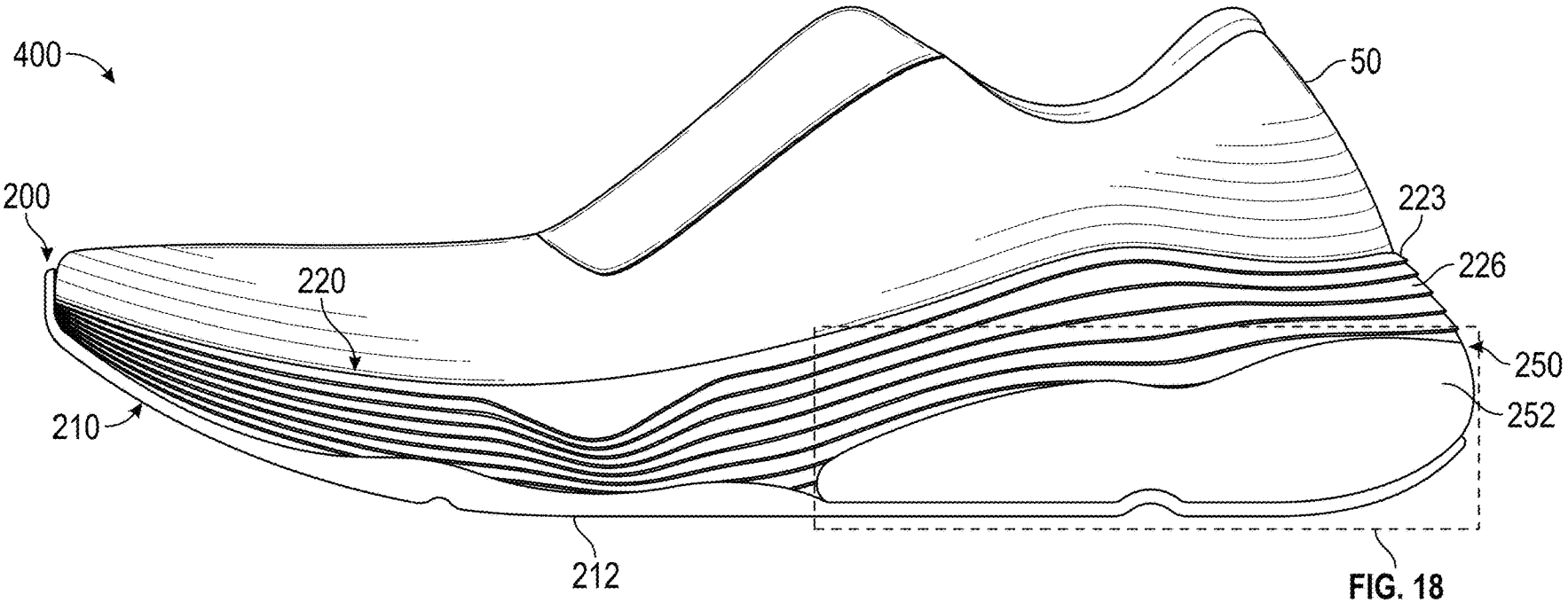
FIG. 10 shows a side view of an article of footwear.
Figure 11:
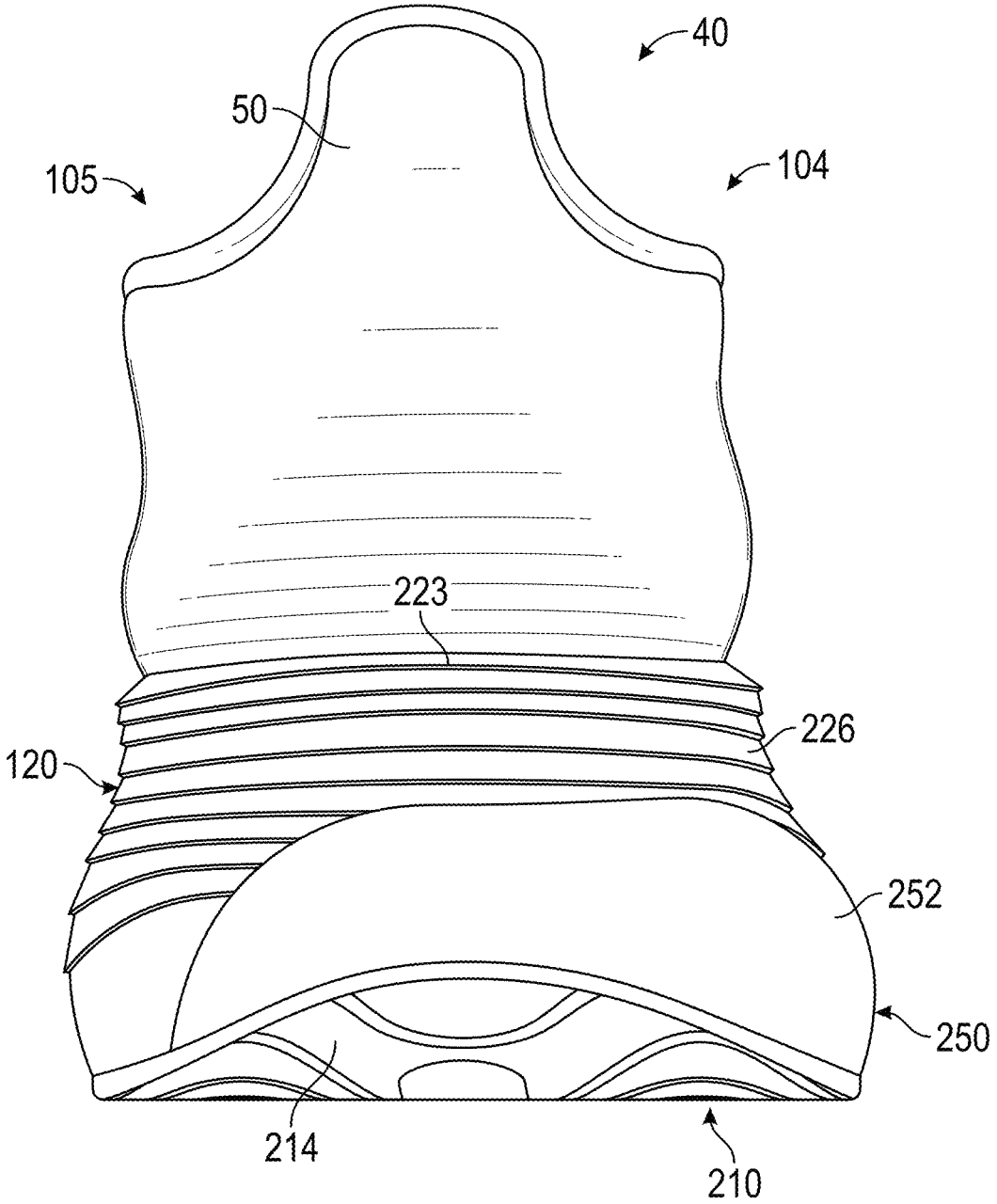
FIG. 11 shows a rear view of the article of footwear shown in FIG. 10.
Figure 19:
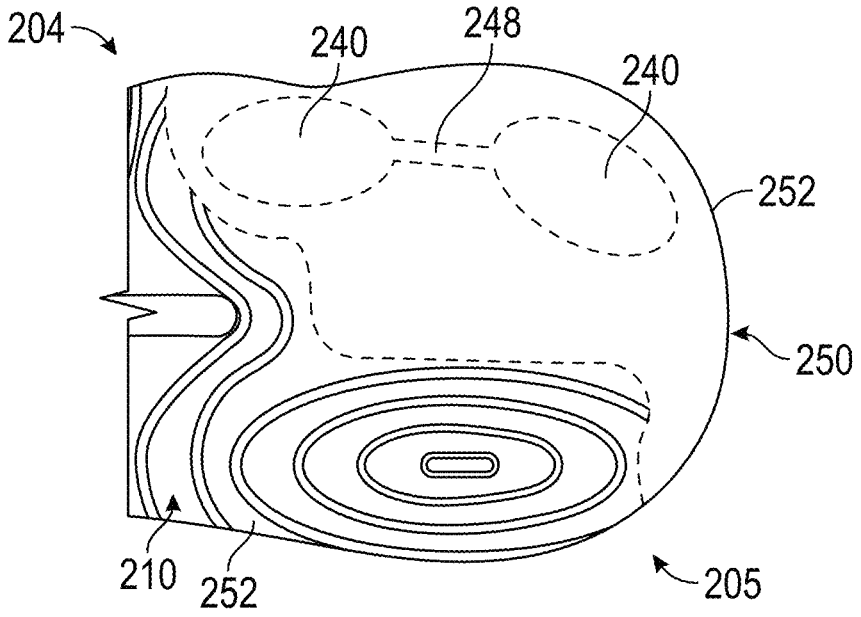
FIG. 19 shows a partial bottom view of a portion of the article of footwear shown in FIG. 12.

With reference to FIG. 19 (showing heel support member 250 schematically in broken lines for simplicity), heel support member 250 may be located entirely in heel region 201 of sole 100. As shown in FIGS. 10 and 11, heel support member 250 may include a convex-shaped exterior surface 252 extending along lateral side 104 of sole 100. Exterior surface 252 of heel support member 250 may extend around back end 223 of midsole 220 from lateral side 204 and terminate along the back of sole 200. By extending along lateral side 204 in heel region 201 of sole 200, heel support member 250 is configured to restrict lateral movement of the wearer's heel.

As shown in FIGS. 14-16, heel support member 250 may include an upper surface 258 extending along the length and the width of heel support member 250. The shape of upper surface 258 may define a curved shape complementary to the shape of recessed surface 228 such that upper surface 258 is disposed flush against recessed surface 228 of midsole 220. With reference to FIG. 15, upper surface 258 of heel support member 250 may define a first member concavity 262 that is aligned with first sole concavity 232 of midsole 220 such that first member concavity 262 and first sole concavity 232 collectively bound a respective heel air chamber 240 disposed along lateral side 104 of sole 100. With reference to FIG. 15, upper surface 258 of heel support member 250 may define a second member concavity 264 that is aligned with second sole concavity 234 of midsole 220 such that second member concavity 264 and second sole concavity 234 collectively bound a respective heel air chamber 240 disposed along lateral side 104 of sole 100. In some embodiments, upper surface 258 may define additional concavities to form more heel air chambers 240 in sole 200.

The plurality of heel air chambers 240 may be fluidly connected to provide dynamic stability that reacts to the motion of the wearer's heel. For example, with reference to FIGS. 18 and 19, sole 100 may include a heel channel 248 (shown schematically in broken line for simplicity) arranged in heel region 201 of sole 200 to interconnect the plurality of heel air chambers 240. Heel channel 248 may be sealed between midsole 220 and heel support member 250. In some embodiments, heel channel 248 may be defined on the upper surface 258 of heel support member 250, such as a groove molded or etched into upper surface 250, which is bounded by a surface (e.g., recessed surface 228) of midsole 220. In some embodiments, the plurality of channels 238 may be defined on a surface (e.g., recessed surface 228) of midsole 220, such as a groove molded or etched into midsole 220, which is bounded by upper surface 258 of heel support member 250.

With reference to FIGS. 15 and 16, in some embodiments, bottom surface 251 of heel support member 250 may define a bottom depression 270 indented into heel support member 250. Similar to bottom depression 225 of midsole 220, the opening of depression 270 of heel support member 250 may be covered by outsole 210 such that outsole 210 and depression 270 collectively bound a respective sole air chamber 230. In some embodiments, bottoms surface 251 of heel support member 250 may define a groove indented into heel support member 250 to form a respective sole channel 238 to fluidly connect sole air chamber 230 defined by depression 270 with sole air chambers 230 defined by bottom depressions 225 of midsole 220. By defining depressions 270 and grooves 272 on bottom surface 251, heel support member 250 allows the plurality of sole air chambers 230 to be arranged to the back of sole 200, thereby providing more cushioning for heel strike motion by the wearer's foot.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the claims and their equivalents.

What is claimed is:

1. An article of footwear, comprising:

an upper; and a sole coupled to the upper, the sole comprising:

an outsole;

a midsole comprising:

a bottom surface facing an upper surface of the outsole, the bottom surface defining a plurality of bottom depressions indented into the midsole;

an exterior side surface extending upward from the bottom surface; and a first recessed surface receding into the midsole away from the exterior side surface of the midsole and the bottom surface, the first recessed surface defining a first midsole concavity indented into the first recessed surface;

a heel support member disposed between the first recessed surface of the midsole and the upper surface of the outsole, the heel support member comprising an upper surface defining a first member concavity indented into the heel support member;

a first heel air chamber disposed between the midsole and the heel support member, the first heel air chamber is bounded by the first midsole concavity and the first member concavity; and a plurality of sole air chambers arranged from a heel region of the sole to a forefoot region of the sole, each of the sole air chambers bounded by a respective bottom depression of the midsole and the upper surface of the outsole.

2. The article of footwear of claim 1, wherein the midsole is formed of a foam-based material having a first durometer, and the heel support member is formed of a thermoplastic material having a second durometer that is greater than the first durometer.

3. The article of footwear of claim 1, wherein the midsole comprises an upper surface located opposite to the bottom surface, the upper surface of the midsole defining a plurality of upper depressions indented into the midsole, the plurality of upper depressions arranged from the heel region of the sole to a midfoot region of the sole.

4. The article of footwear of claim 1, further comprising:

a second heel air chamber disposed between the midsole and the heel support member, the first heel air chamber being in fluid communication with the second heel air chamber.

5. The article of footwear of claim 4, wherein the midsole comprises a second recessed surface receding into the midsole away from the exterior side surface and the bottom surface of the midsole, wherein the first recessed surface is disposed in a lateral section of the sole and the second recessed surface is disposed in a medial section of the sole, and wherein the heel support member is further disposed between the second recessed surface of the midsole and the upper surface of the outsole.

6. The article of footwear of claim 5, wherein the second recessed surface of the midsole defines a second midsole concavity indented into the second recessed surface and the upper surface of the heel support member defines a second member concavity indented into the heel support member, and wherein the second heel air chamber is bounded by the second midsole concavity and the second member concavity.

7. The article of footwear of claim 6, wherein the first heel air chamber is in fluid communication with the second heel air chamber via a heel channel defined between the midsole and the heel support member.

8. The article of footwear of claim 7, further comprising:

a third heel air chamber disposed between the midsole and the heel support member, the third heel air chamber is in fluid communication with the first heel air chamber and the second heel air chamber via the heel channel.

9. The article of footwear of claim 8, wherein the midsole comprises a back end surface disposed in the heel region of the sole, and the heel support member is engaged with the back end surface, wherein the back end surface of the midsole defines a third midsole concavity and the upper surface of the heel support member defines a third member concavity, and wherein the third heel air chamber is bounded by the third midsole concavity and the third member concavity.

10. The article of footwear of claim 4, wherein the first recessed surface of the midsole defines a second midsole concavity indented into the first recessed surface and the upper surface of the heel support member defines a second member concavity indented into the heel support member, and wherein the second heel air chamber is bounded by the second midsole concavity and the second member concavity, wherein the first heel air chamber and the second heel air chamber are disposed on a lateral section of sole.

11. The article of footwear of claim 1, wherein the heel support member defines an opening extending through the upper surface of the heel support member and a bottom surface of the heel support member, and wherein the midsole includes a protrusion received in the opening of the heel support member.

12. The article of footwear of claim 1, wherein the plurality of sole air chambers are spaced apart evenly from the forefoot region of the sole to the heel region of the sole, and the article of footwear further comprises:

a plurality of sole channels bounded by the bottom surface of the midsole and the upper surface of the outsole, the plurality of sole channels are spaced apart evenly from the forefoot region of the sole to the heel region of the sole and fluidly connect the plurality of sole air chambers.

13. The article of footwear of claim 12, wherein the plurality of sole air chambers includes a set of sole air chambers that are each fluidly connected to four adjacent sole air chambers by four sole channels of the plurality of sole channels.

14. The article of footwear of claim 1, comprising:

a second heel air chamber disposed between the midsole and the heel support member, the second heel air chamber is in fluid communication with the first heel air chamber; and a third heel air chamber disposed between the midsole and the heel support member, the third heel air chamber is in fluid communication with the first heel air chamber and the second heel air chamber, wherein the first, second, and third heel air chambers are fluidly isolated from the plurality of sole air chambers.

15. The article of footwear of claim 14, wherein the heel support member comprises an exterior surface extending around a back end of the sole such that the exterior surface of the heel support member forms a part of a lateral sidewall of the sole and a part of a medial sidewall of the sole.

16. The article of footwear of claim 15, wherein the exterior surface of the heel support member forming part of the lateral sidewall of the sole and the medial sidewall of the sole is convex-shaped.

17. The article of footwear of claim 14, wherein the first recessed surface is disposed in a lateral section of the sole.

18. The article of footwear of claim 17, wherein a heel section of the midsole comprises a second recessed surface receding into the midsole away from the bottom surface of the midsole and the exterior side surface of the midsole, the second recessed surface is disposed in a medial section of the sole, and the second recessed surface comprising a second midsole concavity indented into the midsole and bounding the second heel air chamber.

19. The article of footwear of claim 18, wherein the heel section of the midsole comprises a third recessed surface receding into the midsole away from the bottom surface of the midsole and the exterior side surface of the midsole, the third recessed surface is disposed along a back end of the sole, and the third recessed surface comprising a third midsole concavity indented into the midsole and bounding the third heel air chamber.

20. The article of footwear of claim 14, wherein the first heel air chamber is disposed in a lateral section of the sole, the second heel air chamber is disposed in a medial section of the sole, and the third heel air chamber is located between the first heel air chamber and the second heel air chamber along a transverse direction of the sole.

* * * * *